US010343407B2

(12) United States Patent
Takagi et al.

(10) Patent No.: US 10,343,407 B2
(45) Date of Patent: Jul. 9, 2019

(54) LIQUID EJECTION DEVICE

(71) Applicant: BROTHER KOGYO KABUSHIKI KAISHA, Nagoya, Aichi (JP)

(72) Inventors: Yuki Takagi, Aichi (JP); Tatsuya Shindo, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/895,097

(22) Filed: Feb. 13, 2018

(65) Prior Publication Data

US 2018/0272716 A1 Sep. 27, 2018

(30) Foreign Application Priority Data

Mar. 27, 2017 (JP) ..... 2017-061140

(51) Int. Cl.

| | |
|---|---|
| ***B41J 2/045*** | (2006.01) |
| ***B41J 2/165*** | (2006.01) |
| ***B41J 2/175*** | (2006.01) |
| ***B41J 2/195*** | (2006.01) |
| ***B41J 29/38*** | (2006.01) |

(52) U.S. Cl.

CPC ..... *B41J 2/16526* (2013.01); *B41J 2/0454* (2013.01); *B41J 2/04548* (2013.01); *B41J 2/04563* (2013.01); *B41J 2/04573* (2013.01); *B41J 2/16508* (2013.01); *B41J 2/16517* (2013.01); *B41J 2/16523* (2013.01); *B41J 2/16532* (2013.01); *B41J 2/16579* (2013.01);

(Continued)

(58) Field of Classification Search

CPC .... B41J 2/16526; B41J 29/38; B41J 2/16508; B41J 2/16517; B41J 2/16523; B41J 2/16532; B41J 2/17509; B41J 2/195; B41J 2/175; B41J 2/0454; B41J 2/04573; B41J 2/16579; B41J 2/04563; B41J 2/04548

See application file for complete search history.

(56) References Cited

U.S. PATENT DOCUMENTS

2007/0195142 A1* 8/2007 Kachi ..... B41J 2/17509 347/92

FOREIGN PATENT DOCUMENTS

| | | | |
|---|---|---|---|
| JP | H10-6531 | A | 1/1998 |
| JP | 2002-29071 | A | 1/2002 |

(Continued)

*Primary Examiner* — Bradley W Thies

(74) *Attorney, Agent, or Firm* — Scully, Scott, Murphy & Presser, PC

(57) ABSTRACT

The controller obtains temperature data based on a temperature sensor when the controller is in an energized state and stores temperature history information of the obtained temperature data in a storage. The controller determines whether there occurs a non-energized state after a previous purge operation, estimates the temperature data in the non-energized state based on the temperature history information when the non-energized state exists after previous execution of the purge operation, and sets a purge condition of a next purge operation based on an elapsed time from previous execution of the purge operation and the temperature history information stored in the storage, sets the purge condition based on the estimated temperature data in the non-energized state in addition to the elapsed time and the temperature history information when there exists the non-energized state after the previous execution of the purge operation.

20 Claims, 11 Drawing Sheets

(52) U.S. Cl.
CPC ..... *B41J 2/175* (2013.01); *B41J 2/17509* (2013.01); *B41J 2/195* (2013.01); *B41J 29/38* (2013.01)

(56) References Cited

FOREIGN PATENT DOCUMENTS

| | | | |
|---|---|---|---|
| JP | 2007-144837 | A | 6/2007 |
| JP | 2007-283747 | A | 11/2007 |

* cited by examiner

TEMPERATURE HISTORY INFORMATION

| OBTAINED DATE/TIME | TEMPERATURE DATA |
|---|---|
| March 31, 2016 13:15 | 30°C |
| March 31, 2016 14:15 | 28°C |
| March 31, 2016 15:15 | 25°C |
| March 31, 2016 16:15 | 24°C |
| March 31, 2016 17:15 | 23°C |
| March 31, 2016 18:15 | 22°C |
| ⋮ | ⋮ |

FIG. 5A

ACCUMULATED PERIOD TABLE

| ENVIRONMENT TEMPERATURE | PERIOD (h) |
|---|---|
| ~ 15°C | 0 |
| 15 ~ 25°C | 2 |
| 25 ~ 30°C | 5 |
| 30 ~ 35 °C | 3 |
| 35 ~ 40°C | 7 |
| 40 ~ 45°C | 0 |
| 45°C ~ | 0 |
| TOTAL PERIOD (h) | 17 |

FIG. 5B

GROWTH FACTOR TABLE

| | PV (THE NUMBER OF PRINTED SHEETS/MONTH) | | | | | |
|---|---|---|---|---|---|---|
| ENVIRONMENT TEMPERATURE | 0~50 SHEETS | 50~100 SHEETS | 100~150 SHEETS | 150~200 SHEETS | 200~250 SHEETS | 250~ SHEETS |
| ~ 15°C | 1.0 | 1.0 | 1.0 | 1.0 | 1.0 | 1.0 |
| 15 ~ 25°C | 1.0 | 1.0 | 1.0 | 1.0 | 1.0 | 1.0 |
| 25 ~ 30°C | 1.5 | 1.0 | 1.0 | 1.0 | 1.0 | 1.0 |
| 30 ~ 35 °C | 2.3 | 1.8 | 1.0 | 1.0 | 1.0 | 1.0 |
| 35 ~ 40°C | 4.7 | 3.0 | 1.8 | 1.0 | 1.0 | 1.0 |
| 40 ~ 45°C | 8.0 | 7.0 | 5.0 | 1.8 | 1.0 | 1.0 |
| 45°C ~ | 15.0 | 12.0 | 8.0 | 2.3 | 1.3 | 1.0 |

FIG. 5C

| ESTIMATED PERIOD (h) | EXHAUST PURGE |
|---|---|
| 720~820 | WEAK PURGE |
| 820~1500 | MEDIUM PURGE |
| 1500~ | STRONG PURGE |

FIG. 5D

LIQUID EJECTION DEVICE

CROSS-REFERENCE TO RELATED APPLICATIONS

This application claims priority under 35 U.S.C. § 119 from Japanese Patent Application No. 2017-061140 filed on Mar. 27, 2017. The entire subject matter of the application is incorporated herein by reference.

BACKGROUND

Technical Field

The present disclosures relate to a liquid ejection device.

Related Art

Conventionally, there has been known a liquid ejection device provided with a head configured to eject liquid from nozzles formed thereto. In such a liquid ejection device, there is a case where, by the air existing in a fluid passage for supplying the liquid to the nozzles, a liquid ejection failure may occur. In one exemplary conventional liquid ejection device, in order to prevent occurrence of such an ejection failure, a forcible discharge operation to forcibly discharge the air together with the liquid in the fluid passage is executed. Further, in the liquid ejection device, in consideration of a growth speed of the air in the fluid passage being different depending on an environment temperature, the controller provided to the liquid ejection device stores temperature history information representing temperatures detected by the temperature sensor, and determines necessity of such a forcible discharge operation based on the history information.

SUMMARY

Since the controller of the conventional liquid ejection device as described above functions with the power supplied from the power supply (e.g., a commercial power source, a storage battery), if the power supplied from the power supply is cut, the controller cannot store the temperatures detected by the temperature sensor as the temperature history information. As a result, the controller cannot determine the necessity of the forcible discharge operation based on the temperature history information accurately and the ejection failure may occur.

According to aspects of the disclosures, there is provided a liquid ejection device, which is provided with a head formed with nozzles from which liquid is ejected, a tank storing the liquid, a liquid passage connecting the tank and the head, a purge device, a temperature sensor, a storage, a controller and a power supply configured to supply an electrical power to the controller. The controller is configured to execute causing the purge device to perform a purge operation of forcibly discharging the liquid from the nozzles, obtaining temperature data based on a measurement result of the temperature sensor when the controller is in an energized state in which an electrical power is supplied from the power supply and causing the storage to store temperature history information of the obtained temperature data, the temperature data being temperature or at least one of parameters having correlation with the temperature, determining whether there occurs a non-energized state where the electrical power is not supplied from the power supply after the purge operation was previously executed, estimating the temperature data in the non-energized state based on the temperature history information stored in the storage when the controller determines that the non-energized state exists after previous execution of the purge operation and setting a purge condition including at least one of execution timing and a discharged amount of the liquid forcibly discharged from the nozzles by the purge device of a next purge operation to be executed next to the previously executed purge operation based on an elapsed time from previous execution of the purge operation and the temperature history information stored in the storage, the controller setting the purge condition based on the estimated temperature data in the non-energized state in addition to the elapsed time and the temperature history information when the controller determines that there exists the non-energized state after the previous execution of the purge operation.

According to aspects of the disclosures, there is provided a liquid ejection device, which is provided with a head formed with nozzles from which liquid is ejected, a tank storing the liquid, a liquid passage connecting the tank and the head, an exhaust passage diverged from a diverging part at an intermediate part of the liquid passage toward outside, a purge device, a temperature sensor, a storage, a controller and a power supply configured to supply an electrical power to the controller. The controller is configured to execute causing the purge device to perform a purge operation of forcibly discharging air inside the liquid passage together with the liquid through the exhaust passage, obtaining temperature data based on a measurement result of the temperature sensor when the controller is in an energized state in which an electrical power is supplied from the power supply and causing the storage to store temperature history information of the obtained temperature data, the temperature data being temperature or at least one of parameters having correlation with the temperature, determining whether there occurs a non-energized state where the electrical power is not supplied from the power supply after the purge operation was previously executed, estimating the temperature data in the non-energized state based on the temperature history information stored in the storage when the controller determines that the non-energized state exists after previous execution of the purge operation, and setting a purge condition including at least one of execution timing and a total discharge amount of the liquid and the air forcibly discharging from liquid passage toward outside via the exhaust passage in a next purge operation to be executed next to the previously executed purge operation based on an elapsed time from previous execution of the purge operation and the temperature history information stored in the storage, the controller setting the purge condition based on the estimated temperature data in the non-energized state in addition to the elapsed time and the temperature history information when the controller determines that there exists the non-energized state after the previous execution of the purge operation.

BRIEF DESCRIPTION OF THE ACCOMPANYING DRAWINGS

FIG. 1 schematically shows a configuration of an inkjet printer according to a first illustrative embodiment of the present disclosures.

FIG. 5A schematically shows a temperature history information.

FIG. 5B schematically shows an accumulated period table.

FIG. 5C schematically shows a growth factor table.

FIG. 5D schematically shows a relationship between a type of exhaust purge and estimate period according to a second embodiment.

Figure 6A:
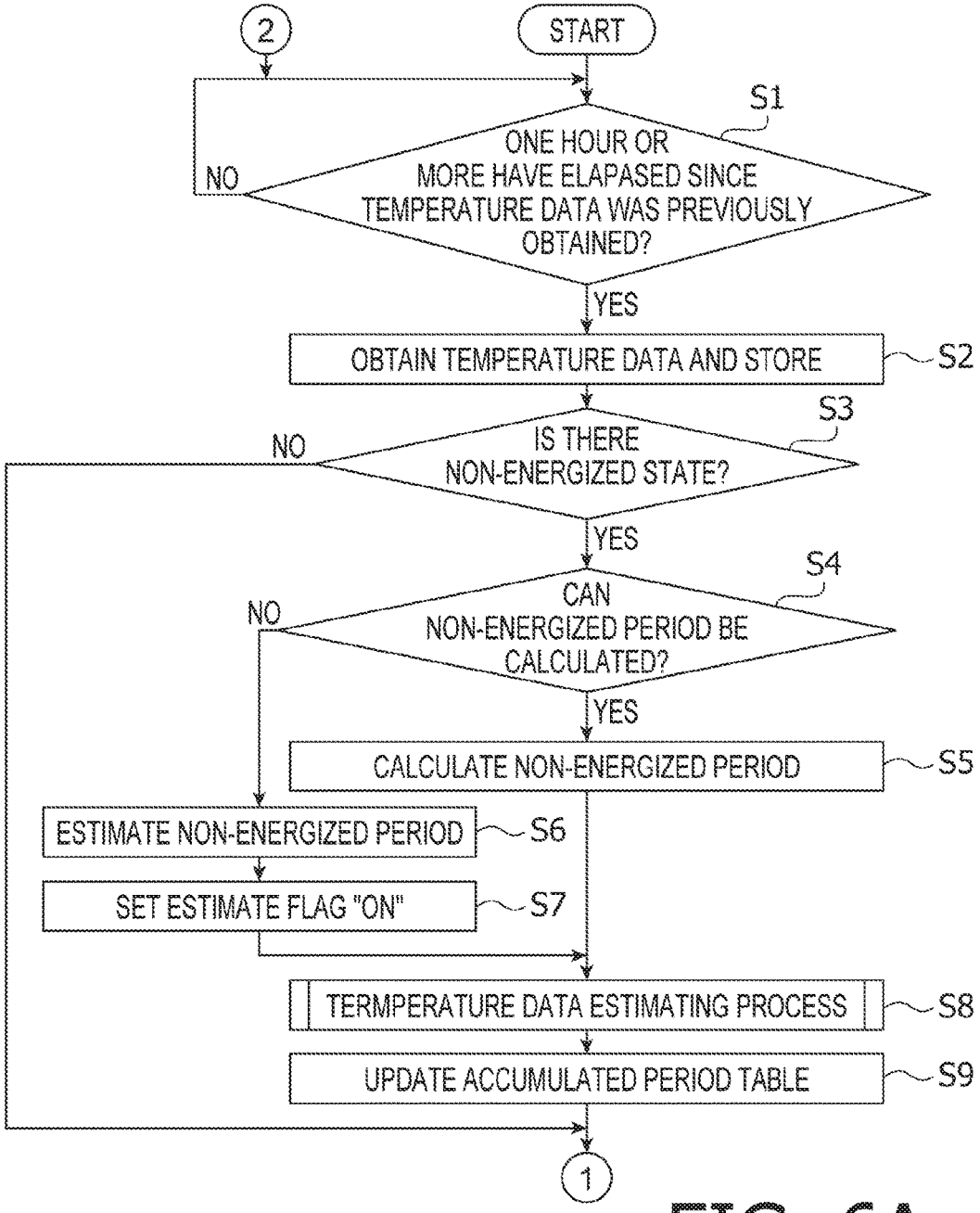
Figure 6B:
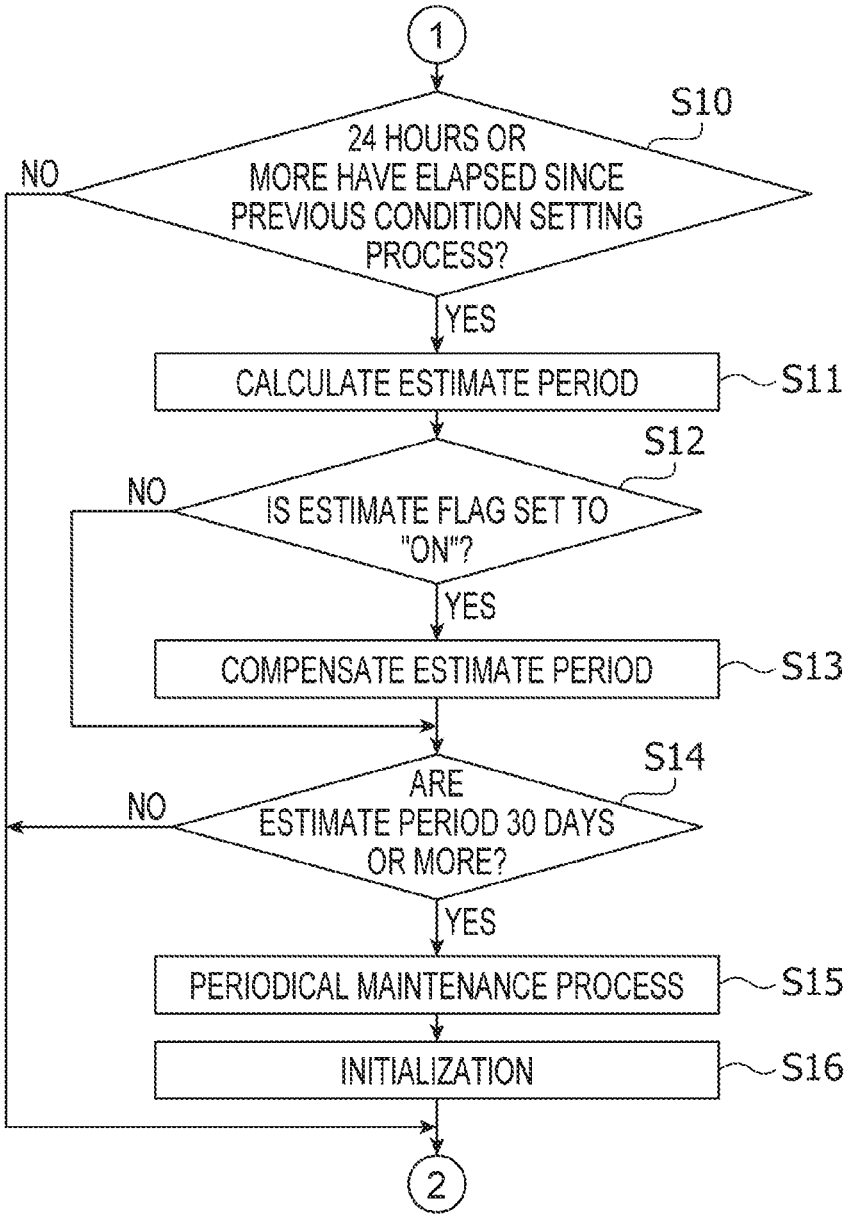

FIGS. 6A and 6B show a flowchart illustrating a main process of the inkjet printer.

Figure 7:
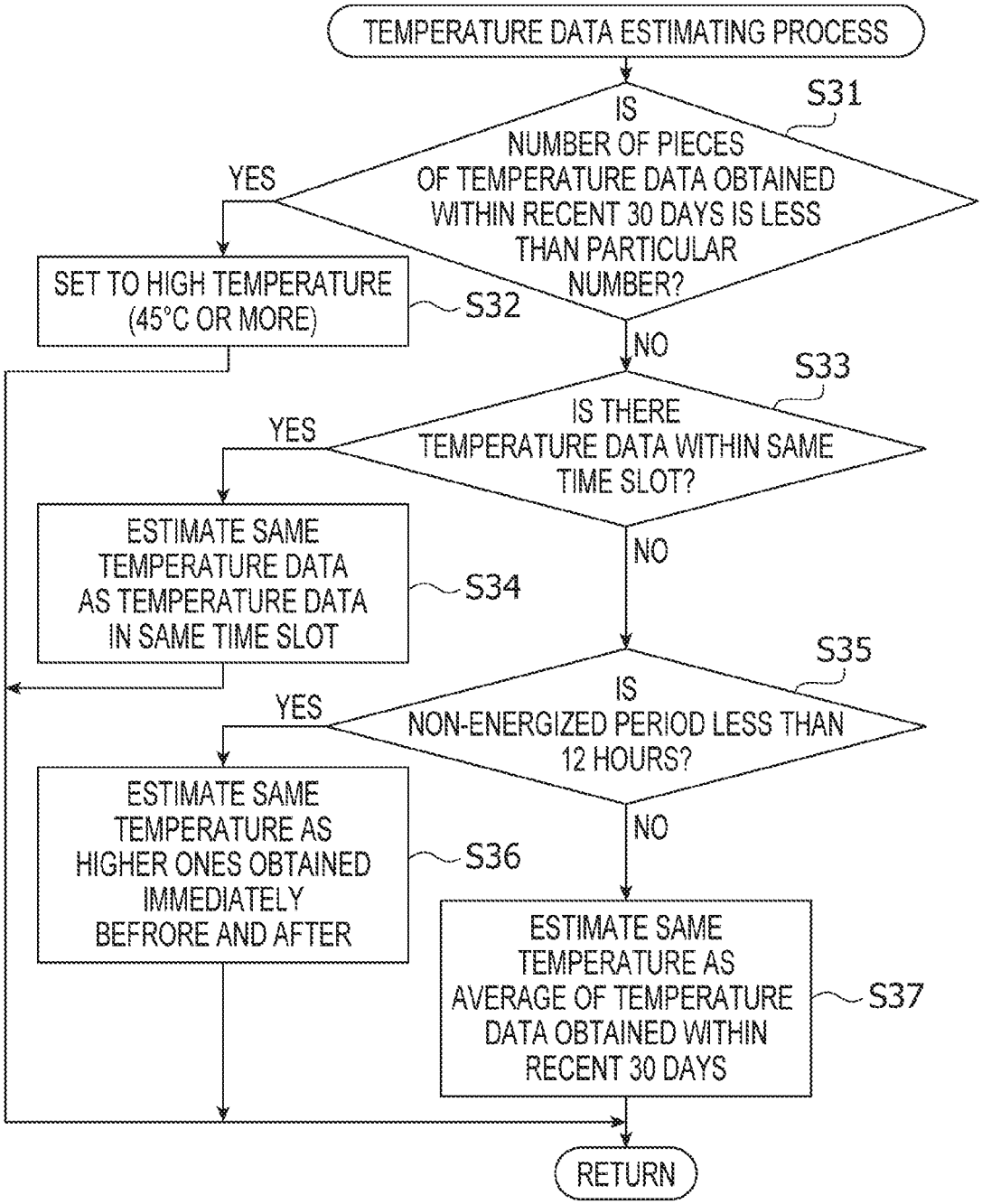

FIG. 7 is a flowchart illustrating a temperature data estimating process.

Figure 8A:
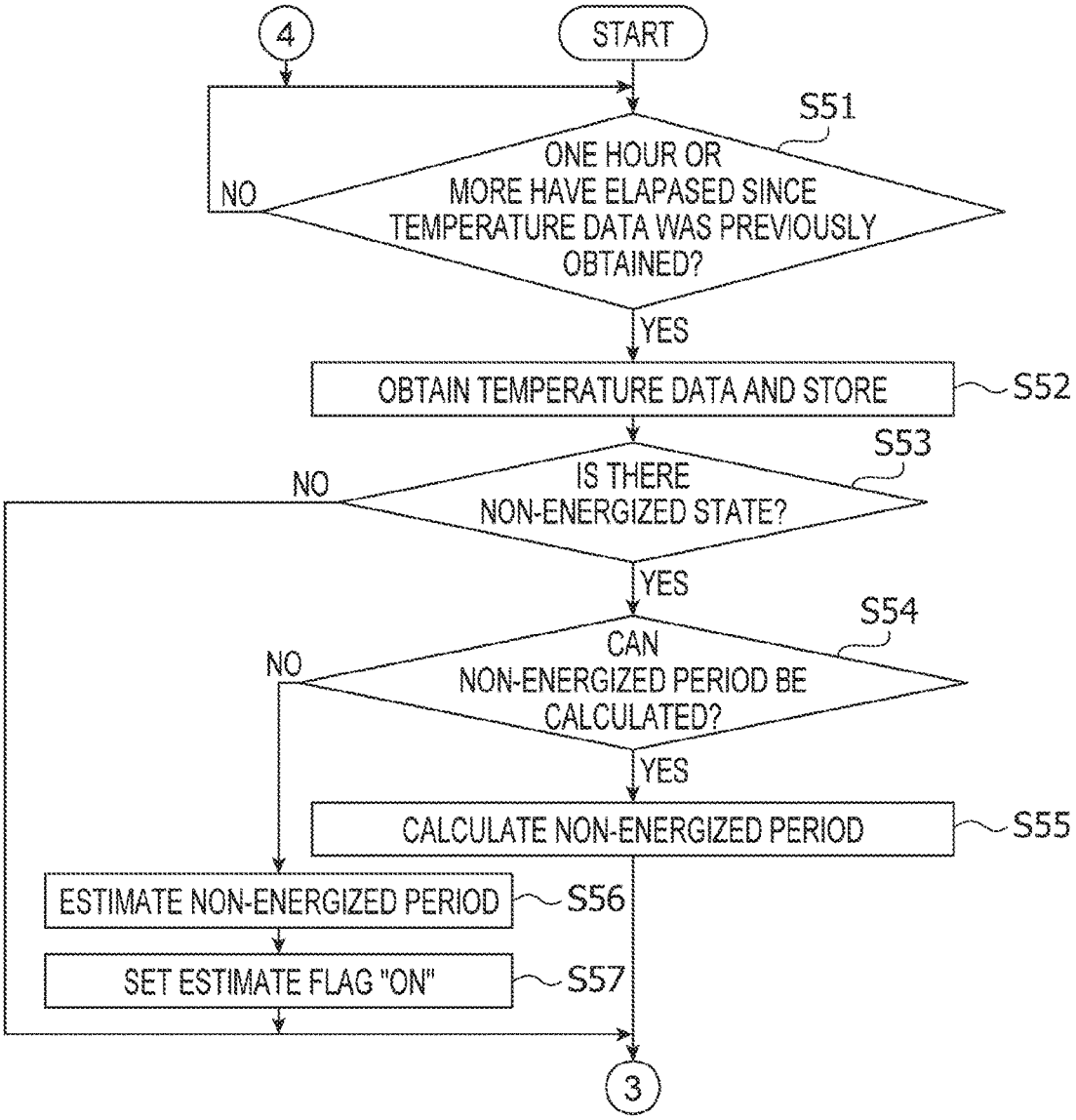
Figure 8B:
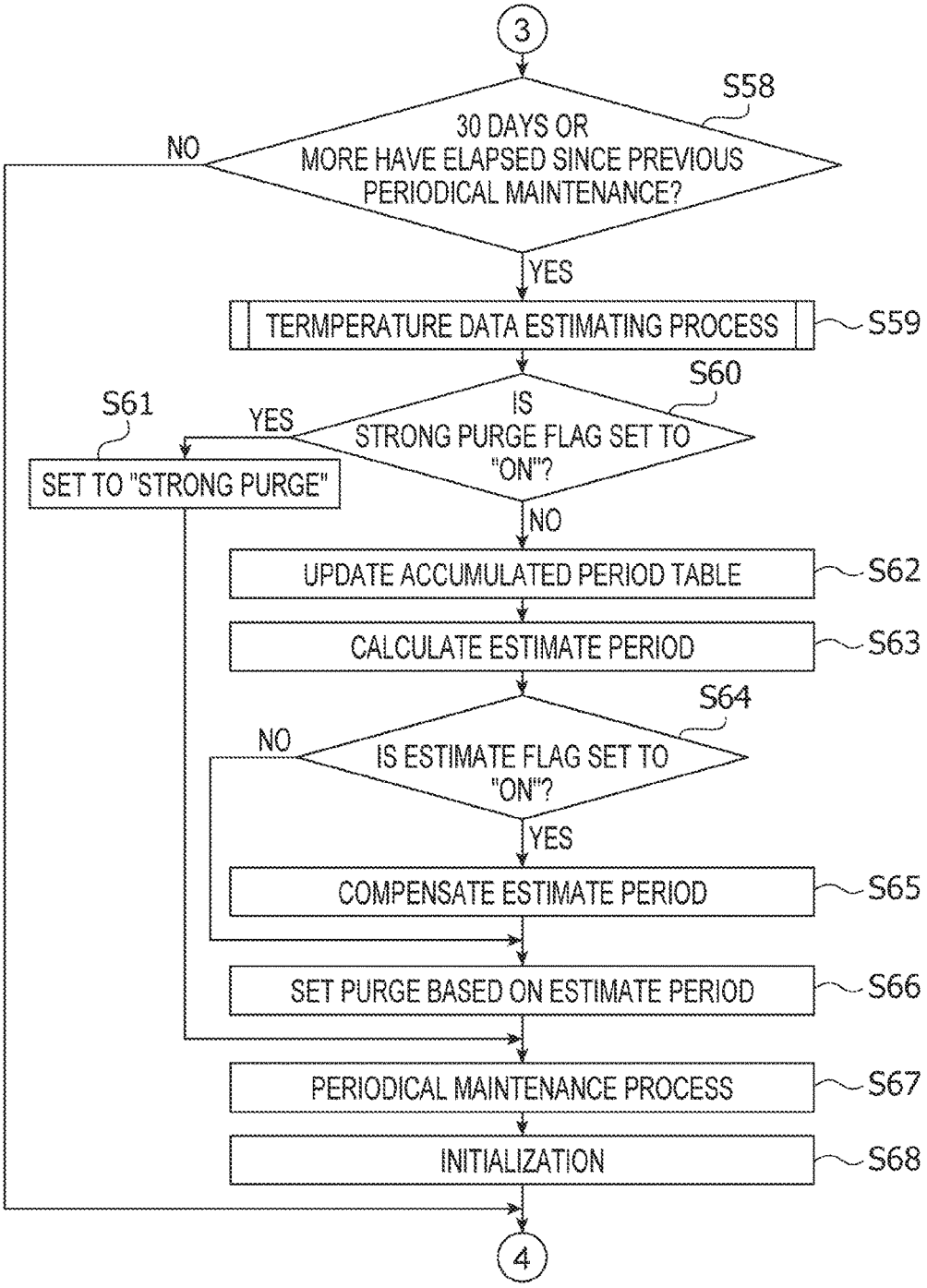

FIGS. 8A and 8B is a flowchart illustrating the main process of the inkjet printer according to the second embodiment.

Figure 9:
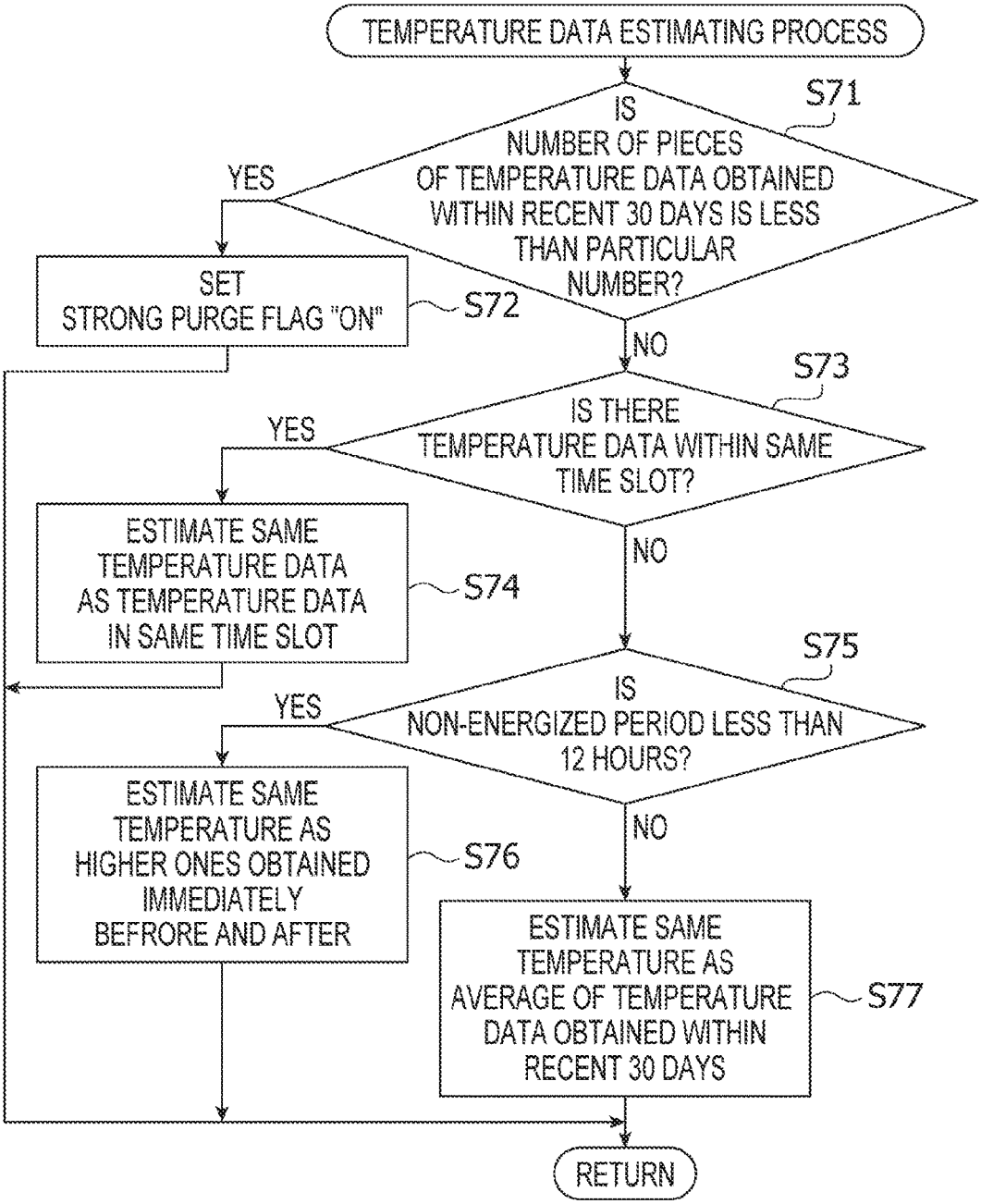

FIG. 9 is a flowchart illustrating the temperature data estimating process according to the second embodiment.

DETAILED DESCRIPTION OF THE EMBODIMENTS

First Embodiment

Figure 1:
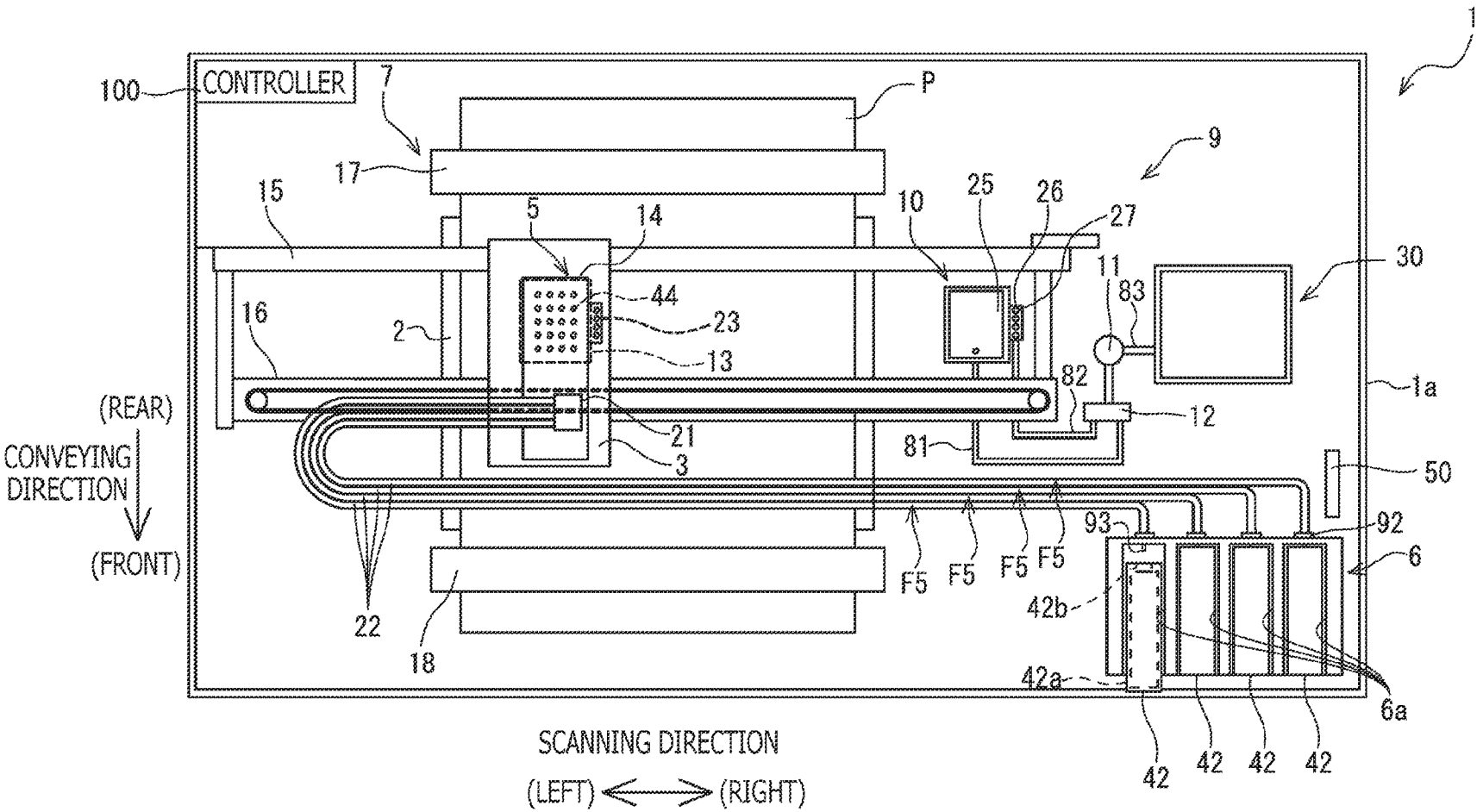
Figure 4:
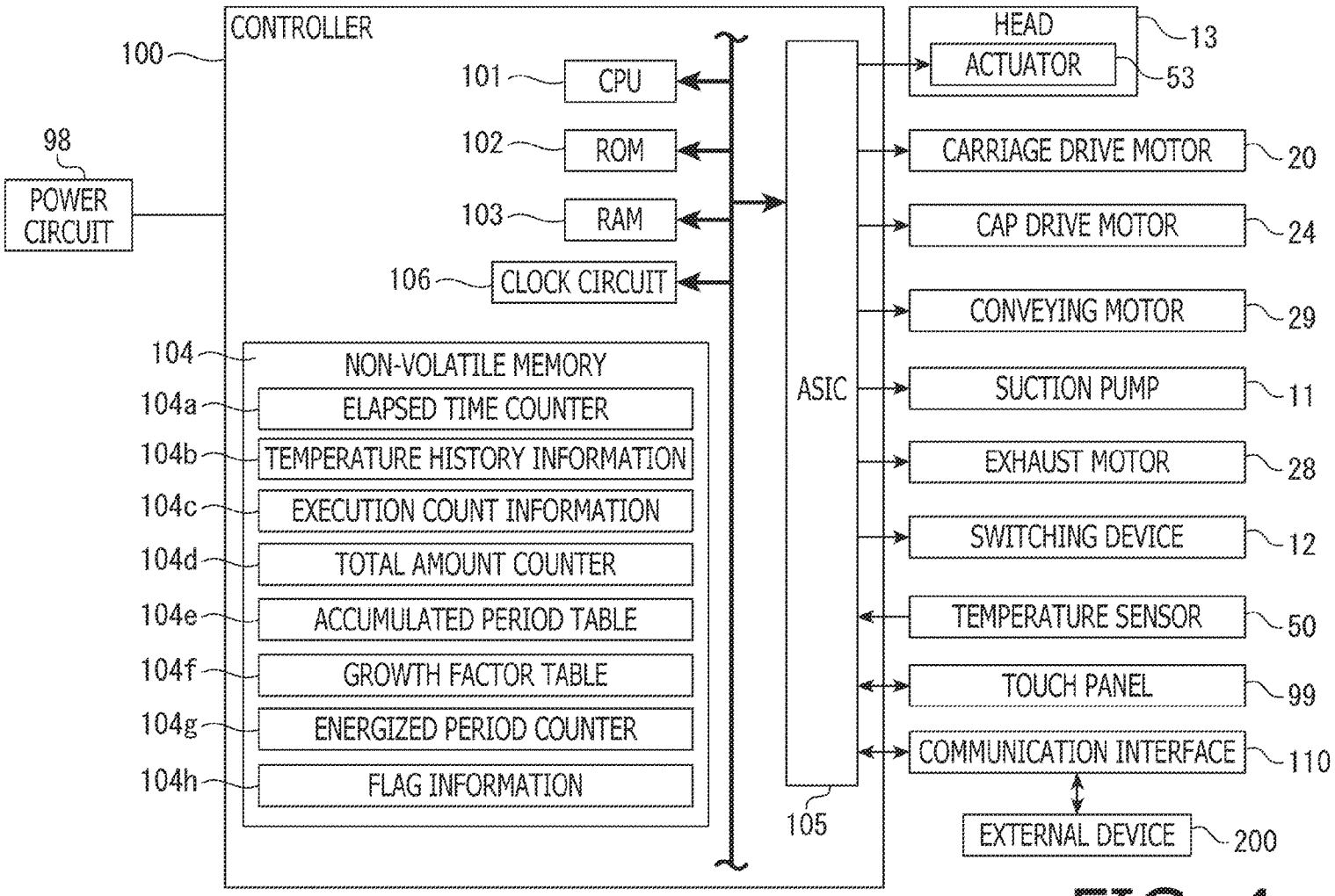
FIG. 4 is a block diagram schematically shows an electrical configuration of the inkjet printer.

Hereinafter, a schematic configuration of an inkjet printer 1 (hereinafter, simply referred to as a printer) according to a first embodiment of the present disclosures will be described. As shown in FIG. 1, the printer 1 has a casing la having a rectangular parallelepiped shape. The casing la accommodates a platen 2, a carriage 3, a head unit 5, a holder 6, a conveyor 7, a purge device 9, a waste liquid tank 30, a temperature sensor 30, a power circuit 98 (see FIG. 4), a touch panel 99 (see FIG. 4), and a controller 100. In the following description, a closer side with respect a plane of FIG. 1 will be referred to as an upside of the printer 1, and a further side with respect the plane of FIG. 1 will be referred to as a down side of the printer 1. Further, a front direction, a rear direction, a right direction and a left direction indicated on FIG. 1 are a front direction, a rear direction, a right direction and a left direction of the printer 1, respectively.

On an upper surface of the platen 2, a sheet P, which is a recording medium, is to be placed. Above the platen 2, two guide rails 15 and 16 extending in parallel in the right-left direction are provided. The carriage 3 is slidably secured to the two guide rails 15 and 16. As a carriage drive motor 20 (see FIG. 4) is driven, the carriage 3 can move, within a range where the carriage 3 faces the platen 2, along the guide rails 15 and 16.

To the holder 6, four colors (i.e., black, yellow, cyan and magenta) of cartridges 42 are detachably attached, respectively. Each cartridge 42 includes a reservoir 42*a*, an outlet pipe 42*b* connected to the ink reservoir 42*a*, and an ink passage 42*c* communicating the ink reservoir 42*a* with an atmosphere. The outlet pipe 42*b* defines the passage through which the ink stored in the reservoir 42*a* is drawn outside the cartridge 42.

Figure 3:
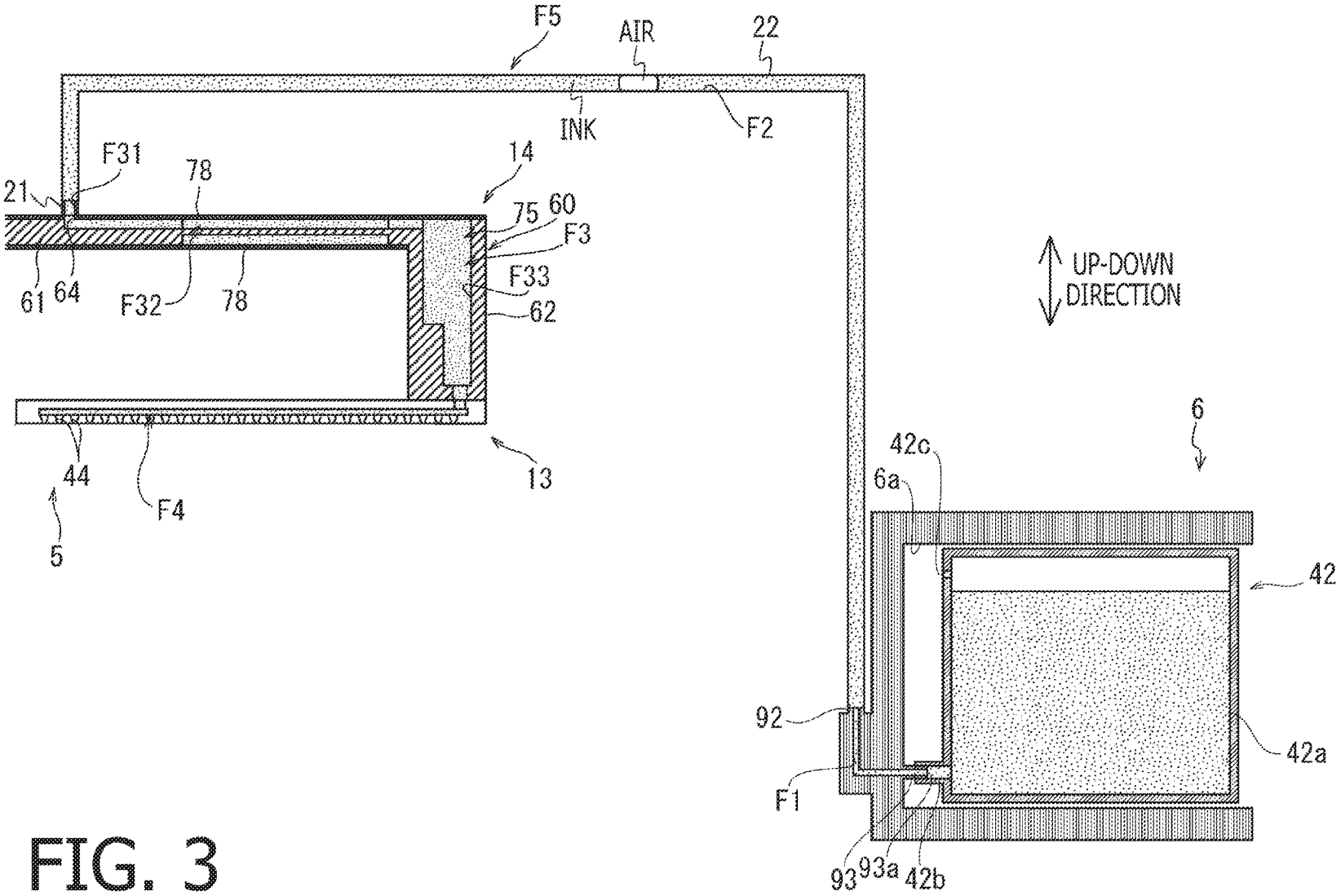
FIG. 3 is a vertical cross-sectional view schematically showing the head unit, an ink cartridge and a cartridge holder.

The holder 6 has a rectangular parallelepiped shape of which front side is closed. The holder 6 is formed with four mounting parts 6*a* on which the four cartridges 42 are mounted, respectively, are arranged in the right-left direction. On each mounting part 6*a*, as shown in FIG. 3, four sets of a joint 99, a needle 93 and an internal passage F1 connecting the same are formed respectively corresponding to the four colors of ink. One end of a supply tube 22 is connected to the head unit 5, and the other end of the supply tube 22 is detachably connected to the joint 92. The supply tube 22 is a flexible tube, inside of which a tube passage F2 is defined.

On an outer circumferential surface of the needle 93, an ink inlet 93*a* communicating with the internal passage F1 is formed. When the cartridge 42 is attached to the mounting part 6*a*, the needle 93 is connected to the outlet pipe 42*b*, thereby the ink inside the reservoir 42*a* flows into the internal passage F1 from the ink outlet 93*a*. According to the above configuration, the ink inside the reservoir 42*a* of the cartridge 42 is supplied to the head unit 5 from the ink inlet 93*a* of the needle 93 through the internal passage F1 and the tube passage F2.

Figure 2:
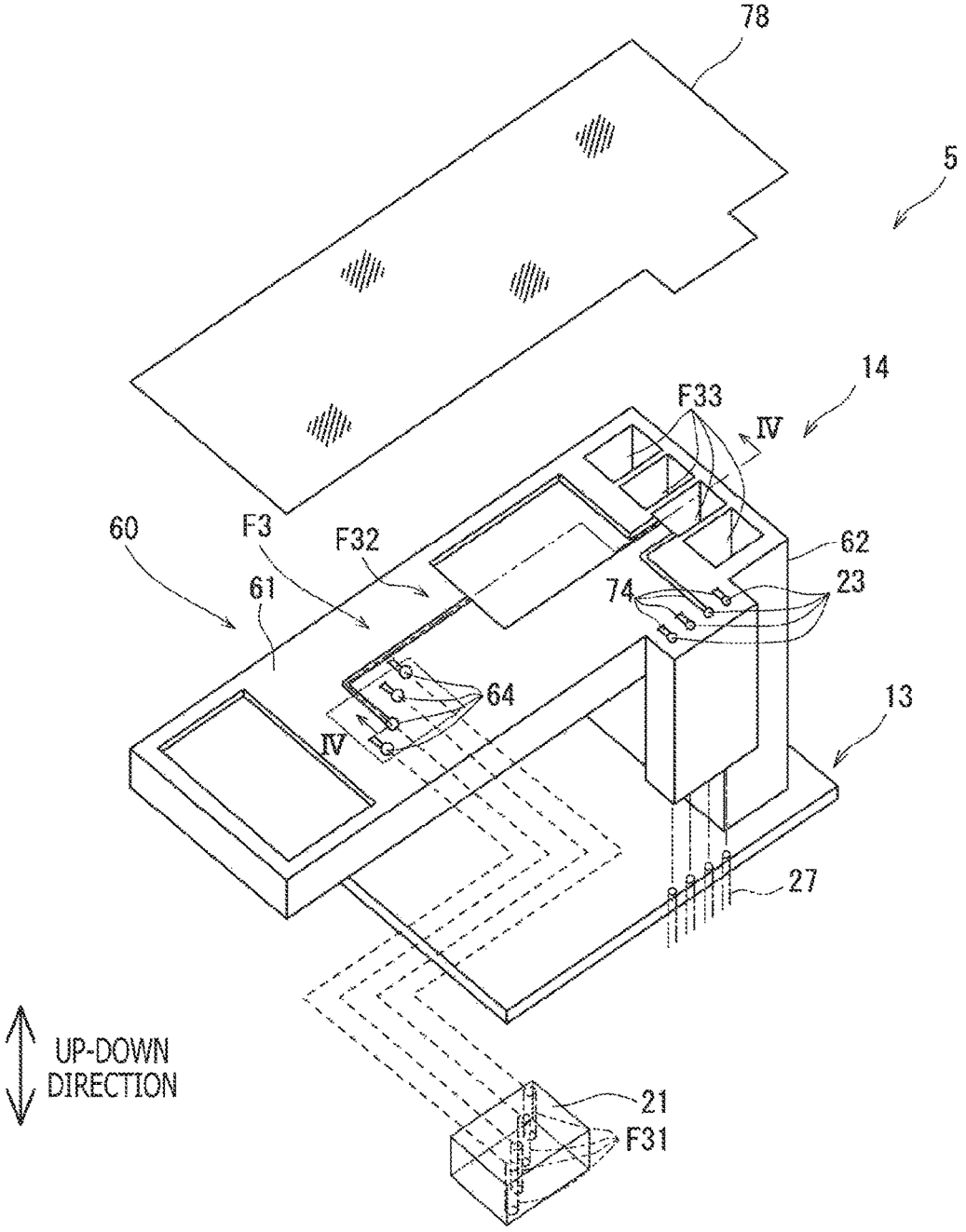
FIG. 2 is an exploded perspective view of a head unit of the inkjet printer.

Referring to FIG. 1, the head unit 5 is secured to a lower part of the carriage 3 such that a clearance is formed between the platen 2 and the head unit 5. As shown in FIGS. 1 and 2, the head unit 5 has a head 13 and a sub tank 14 provided above the head 13. The head 13 is configured such that a lower surface of the head 13 serves as an ink ejection surface on which a plurality of nozzles 44 configured to eject ink droplets are formed. The plurality of nozzles 44 are arranged in a direction perpendicular to a scanning direction (i.e., in a conveying direction of the sheet P), and constitute four lines of nozzle arrays configured to eject four colors of ink, respectively. Inside the head 13, as shown in FIG. 3, a head passage F4 connecting the nozzles 44 and the sub tank 14 and an actuator 53 (see FIG. 4) are provided. The actuator 53 is provided with a plurality of driving elements applying ejection energies (i.e., pressures) to the ink inside the head passage F4 to cause the plurality of nozzles 44 to eject the ink droplets, respectively. The actuator 53 is not limited to a particular configuration, and a piezoelectric actuator may preferably be employed. The piezoelectric actuator includes a plurality of piezoelectric elements configured to apply pressures to the ink making use of deformation of piezoelectric layers due to an inverse piezoelectric effect. Alternatively, as the driving elements, a plurality of heating elements generating bubbles with heat inside the ink may be employed. It is noted that, in FIG. 3, the sub tank 14 is shown as a cross-sectional view taken along a vertical plane extending along IV-IV line in FIG. 2, which the head 13 is shown as a side view, not a cross-sectional view.

The sub tank 14 is a tank temporarily storing the ink to be supplied to the head 13. On the upper surface of the sub tank 14, a joint 21 to which the supply tube 22 can be detachably connected is formed. Further, in the sub tank 14, a supply passage F3 connecting the joint 21 and the head passage F4 is formed (see FIG. 3). Further, in the sub tank 14, four exhaust parts 23 for exhausting the air existing in the supply passage F3 are provided respectively corresponding to the four colors of ink. Inside each of the four exhaust parts 23, a valve configured to switch communication/closed state with outside is disposed. The sub tank 14 will be describe in detail later.

Referring again to FIG. 1, the conveyor 7 has two conveying rollers 17 and 18 which are arranged on front and rear sides, respectively, so as to sandwich the platen 2 and the carriage 3 in the front-rear direction (i.e., the conveying direction). The two conveying rollers 17 and 18 are synchronously driven to rotate by the conveying motor 29 (see FIG. 4) to convey the sheet P placed on the platen 2 in the conveying direction. The printer 1 prints a user-desired image and the like on the sheet P by conveying the sheet P in the conveying direction with the conveyor 7, and causing the ink droplets to be ejected from the nozzles 44 with moving the head unit 5 together with the carriage 3 in the scanning direction.

The purge device 9 is a device used for performing maintenance to maintain/recover the ejection characteristics of the head 13. As shown in FIG. 1, the purge device 9 has a cap unit 10, a suction pump 11, a switching device 12, and tubes 81-83. The cap unit 10 faces the head unit 5 in the up-down direction when the cap unit 10 is moved to a position on the right side with respect to a facing area where the head unit 5 faces the sheet P conveyed on the platen 2. Further, the cap unit 10 is configured to be lifted/lowered as driven by a cap drive motor 24 (see FIG. 4). The cap unit 10 has a nozzle cap 25 and an exhaust cap 26.

In a state where the head unit 5 faces the cap unit 10, the nozzle cap 25 faces the lower surface of the head 13, and the exhaust cap 26 faces the lower surfaces of the four exhaust parts 23 of the sub tank 14. When the cap unit 10 is lifted with the head unit 5 and the cap unit 10 facing each other, the cap unit 10 is attached to the head 13 and the sub tank 14. At this stage, all the nozzles 44 belonging to the four nozzle arrays are commonly covered with the nozzle cap 25, and the exhaust cap 26 is connected to the four exhaust parts 23. To the exhaust cap 26, four rod-like opening/closing members 27 respectively opening/closing the valves in the four exhaust parts 23 are secured. In a state where the exhaust cap 26 is connected to the four exhaust parts 23, the four rod-like opening/closing members 27 are driven to move in the up-down direction by the exhaust motor 28 (see FIG. 4). As the opening/closing members 27 are inserted into the exhaust parts 23 from below and drive the valves disposed therein, respectively.

The tube 81 connects the nozzle cap 25 and the switching device 12, and the tube 82 connects the exhaust cap 26 and the switching device 12. Further, the tube 83 connects the switching device 12 and the waste liquid tank 30. To the tube 83, the suction pump 11 is provided. The switching device 12 selectively switches a communication destination of the tube 83 between the tube 81 and the tube 82. That is, the switching device 12 selectively switches a destination with which the suction pump 11 communicate between the nozzle cap 25 and the exhaust cap 26. By switching the destinations with which the suction pump 11 communicates, the suction purge of forcibly causing all the nozzles belonging to the four nozzle arrays to discharge the liquid, and the exhaust purge of exhausting the air (the air in the air storage 75 described later) in the supply passage F3 of the sub tank 14 are selectively executed.

In the suction purge, the switching device 12 is controlled to make the suction pump 11 communicate with the nozzle cap 25 with the nozzle cap 25 being attached to the head 13 to cover the plurality of nozzles 44. In this state, the suction pump 11 is driven to depressurize (to suck) inside of the nozzle cap 25, and the ink is sucked from respective ones of the plurality of nozzles 44 of the head 13, thereby making the plurality of nozzles 44 to discharge the liquid, respectively. According to the above configuration, foreign substances, bubbles, high-viscosity ink due to drying and the like are discharged from the nozzles 44, thereby ejection characteristics of the head 13 being recovered.

In the exhaust purge, the exhaust cap 26 is connected to the exhaust part 23, and the switching device 12 is controlled to communicate the suction pump 11 with the exhaust cap 26 with the valves in the exhaust parts 23 being opened by the opening/closing member 27. In this state, the suction pump 11 is driven so that a negative pressure is applied to the exhaust parts 23. According to the above configuration, the air in the supply passage F3 of the sub tank 14 is lead to the exhaust cap 26 before the air flows into the head 13. As a result, it is possible to suppress deterioration of the ejecting characteristics of the head 13. The ink discharged from the head unit 5 by the suction purge and the exhaust purge is sent to the waste liquid tank 30 through the tubes 81, 82 and 83.

The temperature sensor 50 is configured to measure atmospheric temperature (e.g., thermistor) and transmit a voltage signal corresponding to the atmospheric temperature to the controller 100. By receiving the voltage signal transmitted from the temperature sensor 50, the controller 100 obtains temperature data representing the temperature measured by the temperature sensor 50. It is noted that the temperature data may not represent the temperature itself, but parameters correlating to the temperature. The parameter may have a larger value as the temperature is higher, or the parameter may have a smaller value as the temperature has a smaller value. According to the illustrative embodiment, the temperature sensor 50 may be arranged in the vicinity of the head 13 which generates heat when driven, or in the vicinity of the holder 6, which is remote from the driving parts such as the conveyor 7. However, the arrangement position of the temperature sensor 50 need not be limited to the vicinity of the holder 6. For example, a substrate to which a sensor for detecting remaining amount of the ink of the cartridge 42 may be secured to the holder 6, and the temperature sensor 50 may be secured to the substrate. Alternatively, the temperature sensor 50 may be arranged on the right side or rear side of the waste liquid tank 30.

The power circuit 98 is a circuit for receiving electric power from a commercial power source (not shown). Specifically, the power circuit 98 has a power plug. By inserting the power plug into an electrical outlet connected to the commercial power source, the electrical power can be received from the commercial power source. The power circuit 98 converts the electrical power received from the commercial power source to appropriate voltages and supplies the same to respective components such as the controller 100 in the printer 1. It is noted that, according to the present embodiment, the power circuit 98 does not have a storage battery. Therefore, when the power plug is removed from the electrical outlet and the electrical power is not received from the commercial power source, the power circuit 98 cannot supply the driving electrical power to the controller 100 and the like.

The controller 100 has a CPU 101, a ROM 102, a RAM 103, a non-volatile memory 104, an ASIC 105 including various control circuits and a clock circuit 106. To the ASIC 105, the head 13, the suction pump 11, the switching device 12, the touch panel 99, the communication I/F 110 and the like are electrically connected.

The ROM 102 stores various programs to be executed by the CPU 101 and various pieces of fixed data. The RAM 103 temporarily stores data (e.g., image data) when the programs are executed. In the non-volatile memory 104, various pieces of information are stored. The clock circuit 106 is a circuit such as an RTC (real time clock), and has a function of an internal clock to measure date and time, and a function of a timer to measure a time period. The clock circuit 106 is driven to operate as the driving power is supplied from the power circuit 98. Further, a current time measured by the clock circuit 106 is compensated based on the date/time obtained from an NTP server on the Internet or an external device 200 connected to the NTP server through a communication interface 110.

The CPU 101 executes the programs stored in the ROM 102 to execute various processes to control, through the ASIC 105, the operations of the head 13, the purge device 9 and the like. It is noted that, in the following description, it is assumed that the various processes are executed by the CPU 101. However, the controller 100 may have a plurality of CPU's which execute processes in a shared manner. Alternatively, the controller 100 has a plurality of ASIC's which execute the processes in a shared manner Further alternatively, the processes may be executed by a single ASIC. The processes executed by the CPU 101 will be describe in detail later.

Next, a concrete configuration of the sub tank 14 will be described in detail with reference to FIGS. 2 and 3. The sub tank 14 is a passage member configured with resin molding 60 and film 78. Inside the sub tank 14, four supply passages F3 configured to respectively supply four colors of ink to the head 13 are formed. In FIGS. 2 and 3, a connection configuration of the supply passage F3 corresponding to only one color of ink is shown for brevity.

The resin molding 60 includes a body part 61 which is a plate-like part extending in a horizontal surface, a connection part 62 extending vertically downward from one end part of the main body part 61, and a joint 21 secured to the upper surface of the main body part 61. To the joint 21, four supplying tubes 22 connected to the holder 6 are detachably connected.

Each supply passage F3 includes an in-joint passage F31 formed at the joint 21, a main-body passage F32 formed to the body part 61, and a connection passage F33 formed to the connection part 62. On the upper surface of the main body part 61, four ink inlets 64 are formed respectively corresponding to the four colors of ink. To each of the four ink inlets 64, one end of each of the four main-body passages F32 is connected. The joint 21 is secured to the upper surface of the main body part 61 so as to cover the ink inlets 64. The in-joint passage 31 formed to the joint 21 is a passage connecting the ink inlets 64 and the tube passage F2.

The main-body passage F32 extends along the horizontal plane, and includes a dumper chamber configured to absorb pressure variation generated in the ink inside the main-body passage F32. The connection passage F33 extends vertically downward from one end (i.e., an upper end) which is connected to the main-body passage F32. As shown in FIG. 2, four groove-like exhaust passages 74 connect the four connection passages F33 with the four exhaust parts 23, respectively. That is, in the main-body part 61, exhaust passages 74 which diverge from an intermediate part of the supply passage F3 are formed. It is noted that, regarding the exhaust passages 74, only one exhaust passage 74 which is formed on the upper surface of the main-body part 61 is shown, and the other exhaust passages 74 are not shown for brevity.

On each of the upper surface and the lower surface of the main-body part 61, a film 78 is molded. Specifically, the main-body passage F32 and the exhaust passages 74 formed to the main-body part 61 are covered with the films 78 from above or below. The upper ends of the four connection passages F33 formed to the connection part 62 are covered with the film 78, while the lower ends are connected to the head passage F4 of the head 13. The upper end of the connection passages F33 serves as the air storage 75 temporarily store the air (see FIG. 3). In the following description, a passage configured by the internal passage F1, the tube passage F2 and the supply passage F3 and connecting the ink inlet 93*a* of the needle 93 and the head 13 will be referred collectively to as the ink passage F5 (FIG. 3).

Next, various processes executed by the CPU 101 will be described. According to the present embodiments, the CPU 101 executes a printing process, a maintenance process and a purge condition setting process in accordance with the programs stored in the ROM 102. The printing process is a process of printing an image on the sheet P as the CPU 101 controls the head 13 and the carriage drive motor 20 when, for example, the print command is received from the external device 200 such a PC through the communication I/F 110.

The maintenance process is a process of causing the purge device 9 to execute the suction purge and exhaust purge for maintaining and recovering the characteristics of the head 13. In the present embodiment, the maintenance process is generally divided into two process: a user maintenance process; and a periodical maintenance process. The user maintenance process is a maintenance process executed in accordance with operations of the touch panel 99 by the user.

The periodical maintenance process is a maintenance process which is automatically executed periodically. In each periodical maintenance process, the CPU 101 causes the purge device 9 to execute the suction purge and the exhaust purge. As a result, the ejection characteristics of the head can always be maintained in a good condition. Therefore, when the print command is received, the CPU 101 can start the printing process without executing the maintenance process. That is, the time period from the reception of the print command to start of the printing process can be shortened. It is noted that driving condition of each of the suction pump 11 in the suction purge and the exhaust purge in the periodical maintenance are fixed. That is, the purge amount (i.e., total of the ink discharge amount and the air discharge amount) of the suction purge and the purge amount of the exhaust purge) are fixed, respectively.

Next, an execution period of the periodical maintenance process will be described. According to the present embodiment, the execution period of the periodical maintenance is basically set to 30 days, and the execution period of the periodical maintenance can be shortened when a particular condition is satisfied.

In the ink passage F5, both the ink and the air exist. The air may be, for example, the air entered from the ink inlet 93*a* at the tip end of the link passage F5 when the cartridge 42 is attached to the holder 6, minute amount of air included in the ink, the air generated as water in the ink within the ink passage F5 is evaporated with the lapse of time, and the like. The air in the ink passage F5 moves toward the nozzle 44 side as the ink is ejected or discharged from the head unit 5. After the air has reached the air reservoir 75, the air is exhausted outside by the exhaust purge.

The air in the ink passage 5 grows with time as the air infiltrating in the ink passage F5 through outer wall of the passage members. That is, the amount of the air increases with time. Unless the ink is ejected or discharged from the head unit 5, the air does not move but stays the same position. Further, a growing speed of the air (i.e., growth rate) is larger as the environmental temperature of the ink passage F5 is higher. Therefore, if the periodical maintenance process is executed at every 30 days, the air grows largely until the air moves to the air reservoir under a high temperature environment and print frequency is low. Thus, even if the periodical maintenance process is executed, the air cannot be exhausted sufficiently, which results in deterioration of the ink ejection characteristics.

Therefore, according to the present embodiment, the purge condition setting process for setting an execution timing of a next periodical maintenance process based on the printing frequency and temperature data obtained based on the measurement results of the temperature sensor since the previous periodical maintenance process was executed. Concretely, the CPU 101 assumes the lapse time since the previous execution of the periodical maintenance process is a longer than actual period as the printing frequency is smaller and the obtained temperature data indicates a higher temperature, and determines a time point at which the assumed time is 30 days as the execution timing of the next periodical maintenance process.

Hereinafter, matters related to the purge condition setting process will be described. In the non-volatile memory 104, an elapsed time counter 104*a*, temperature history information 104*b*, execution count information 104*c*, a total amount counter 104*d*, an accumulated period table 104*e*, and a growth factor table 104*f*, which are referred to when the purge condition setting process is executed.

The elapsed time counter 104*a* is a counter configured to count the elapsed time (elapsed time count value) since a time point at which the previous execution of the periodical maintenance process. The CPU 101 increments the elapsed time count value of the elapsed time counter 104*a* based on the period measured by the clock circuit 106.

The temperature history information 104*b* is history information of obtained temperature data, in which the temperature data and date/time when the temperature data was obtained are associated with each other. The CPU 101 obtains the temperature data based on the measurement results of the temperature sensor 50 and current date/time from the clock circuit 106, and store the same in an associated manner as the temperature history data.

The execution count information 104*c* is information including the elapsed time count value counted by the elapsed time counter 104*a* in the previous execution of the history information storing process. When it is determined, referring to the current elapsed time count value of the elapsed time counter 104*a* and the execution count information 104*c*, that a particular period or more (i.e., one hour or more) has elapsed since the previous execution of the history information storing process, the CPU 101 executes the history information storing process. That is, the CPU 101 executes the history information storing process at every one hour.

The total amount counter 104*d* is a counter for counting the total amount of the ink (i.e., total amount count value) ejected or discharged outside from the head unit 5 by the printing process or the maintenance process since the previous execution of the periodical maintenance process.

The CPU 101 calculates the total amount of the ink and the air ejected or the discharged every time when the printing process or the maintenance process is executed after the previous execution of the periodical maintenance process, and adds the calculated total amounts to the total amount of the total amount counter 104*d*. It is noted that, when the printing process is executed, the ejection amount of the ink ejected from the nozzles 44 as the actuator 53 is driven can be calculated from the image data which is subject to the printing process. Further, the purge amount of the suction purge or the exhaust purge in the maintenance process can be calculated based on the driving condition of the suction pump 11.

The CPU 101 executes a PV number calculation process of calculating the number of printing sheets per month (i.e., per 30 days) (hereinafter, referred to as a PV number) referring to the total amount counter 104*d* and the elapsed time counter 104*a*. Concretely, the CPU 101 calculates the PV number based on a value which is obtained by dividing the total amount count value indicated by the total amount counter by the elapsed time count value of the elapsed time counter 104*a*.

The accumulated period table 104*e* is a table indicating the accumulated period for each of a plurality of environmental temperature ranges (e.g., seven environmental temperature ranges) when the printer 1 (i.e., the passage F5) belongs to the temperature range since the previous execution of the periodical maintenance process. The total period totaling the accumulated periods of the plurality of environmental temperature ranges indicate the elapsed time since the previous execution of the periodical maintenance. Therefore, the accumulated period table 104*e*, in other words, is the temperature history information of the temperature data since the previous execution of the periodical maintenance process.

In the history information storing process, when the temperature data is obtained, it is assumed that the environmental temperature of the printer 1 within a time zone from the previous execution of the history information storing process to the current time is represented by the obtained temperature data. Then, in the accumulated period table 104*e*, one hour is added to the accumulated time corresponding to the environmental temperature range to which the obtained temperature data belongs.

The growth factor table 104*f* is a table defining growth factors to be multiplied with the accumulated period of the accumulated period table 104*e* for respective ones of a plurality of ranges of the PV number. The minimum value of the growth factor is 1.0. It is noted that as the PV number decreases, the growth factor increases, and as the environmental temperature increases, the growth factor increases. The growth factor is set by experiment and simulation.

In the purge condition setting process, the CPU 101 executes an estimate time obtaining process to obtain an estimate period regarding the elapsed time since the previous execution of the periodical maintenance based on the accumulated period table 104*e*, the growth factor table 104*f*, and the PV number calculated in the PV number calculation process. Concretely, the total period obtained by multiplying the growth factors for the ranges of the PV number calculated in the PV number calculation process for the accumulated periods of respective environment temperature ranges in the accumulated period table 104*e* is regarded as the estimate period. For example, when the calculated PV number is 20, the growth factor corresponding to the range of 0-50 sheets in the growth factor table is used. When the accumulated period table 104*e* is the table shown in FIG. 5B, the estimate period is calculated to be 49.3 ($=2\times1.0+5\times1.5+3\times2.3+7\times4.7$) hours. As above, the estimate time is longer than the actual elapsed time (17 hours).

Next, the CPU 101 determines, in the purge condition setting process, whether or not the calculated estimate period is 30 days (i.e. 720 hours) or more. When it is determined that the estimate time is less than 30 days, the CPU 1010 determines that it is not the execution timing of the next periodical maintenance process. When it is determined that the estimate period is 30 days or more, the CPU 101 determines that it is the execution timing of the next periodical maintenance process, and executes the periodical maintenance process. As described above, the execution timing of the periodical maintenance process is set depending on the environment temperature since the previous execution of the periodical maintenance process, or the PV number (print frequency), occurrence of the ejection failure can be suppressed.

The execution count information 104*c* includes the elapsed time count value of the elapsed time counter 104*a* at the previous execution of the purge condition setting process. When the CPU 10 refers to the elapsed time count value of the elapsed time counter 104*a* and the execution count information 104*c*, and determines that 24 hours or more have elapsed since the previous execution of the purge condition setting process, the CPU 101 executes the purge condition setting process. That is, the CPU 101 executes the purge condition setting process at every 24 hours.

Incidentally, the CPU 101 is configured to execute the above-described processes only in an energized state in which the CPU 101 receives the driving power from the power circuit 98. In other words, when the CPU 101 is non-energized state in which the CPU 101 does not receive the driving power from the power circuit 98, the CPU 101 does not execute the various processes such as the history information storing process. Therefore, in the non-energized state, the CPU 101 cannot obtain the temperature data during the non-energized state, and the elapsed time count value of the elapsed time counter 104*a* is inaccurate. Therefore, among the plurality of environmental temperature ranges of the accumulated period table 104*e*, the accumulated period of at least one of the environmental temperature ranges is inaccurate. In such a case, the purge condition setting process cannot be executed appropriately.

Therefore, according to the present embodiment, in order to solve the above problem, the CPU 101 executes a non-energized period obtaining process to obtain a non-energized period, a temperature data estimating process to estimate the temperature data during the non-energized state, and a table update process to compensate the accumulated period in the accumulated period based on the obtained non-energized period, and the estimated temperature data.

The non-energized period obtaining process will be described. In the non-volatile memory 104, the energized period counter 104*g* which is referred to in the non-energized period obtaining process is stored. The energized period counter 104*g* is a counter for counting the accumulated energized period (energized period count value) of the controller 100 since the previous execution of the non-energized period obtaining process. The CPU 101 increments the energized period count value of the energized period counter 104*g* based on the period counted by the clock circuit 106, similar to the elapsed time count value of the elapsed time counter 104*a*.

As mentioned before, when the controller 100 receives, through the communication I/F 110, various commands (e.g., print command) from the external device 200 connected to the Internet, the controller 100 also obtains the time information. Therefore, it is possible to compensate the current time measured by the clock circuit 106 based on the obtained time information, and as result, it is possible to calculate the non-energized period. For example, even though there occurs the non-energized state after the previous execution of the periodical maintenance is executed, if the time information is received before and after the non-energized state, the elapsed time between the receptions of the time information can be calculated. Further, based on the energized period count value of the energized period counter 104*g* at each reception of the time information, the energized period between the receptions of time information can be calculated. Therefore, by subtracting the energized period from the elapsed time between the points of time where the time information was received, the non-energized period can be calculated.

However, if the time information was not received from the external device 200 before and after the non-energized state, the non-energized period cannot be calculated according to the above method. In particular, there could be a case where the printer 1 is used as a stand-alone device which is not connected to the external device 200 connected to the Internet. In such a case, since the time information cannot be obtained from the external device 200, the non-energized period cannot be calculated. Even in such a case, however, making use of internal information of the printer 1, such as the energized count value of the energized period counter 104*g*, the non-energized period when the controller 100 is in the non-energized state can be estimated to some extent.

In the usage sate of the user (e.g., a time zone when the user inserts the power plug to the electrical outlet, a period of time during which the power plug is inserted in the electrical outlet, a time zone within which the user removes the power plug from the electrical outlet, and a period of time during which the power plug is removed from the electrical outlet) may exhibit a usage tendency of the user. Although such usage tendency may be different for different users to be exact, there is a general tendency based on the usage (e.g., an office use, a factory use, a store-use) or countries/areas where the printer 1 is placed. Such a general tendency can be known by a market research. If it is assumed that the user uses the printer 1 in accordance with the general usage tendency as described above, it is possible to estimate the non-energized period to some extent based on the energized period.

According to one example of the usage tendency, there is a case where the user inserts the power plug in the electrical outlet every day, and the power plug is being inserted for more than six hours in one day. In such a case, the controller 100 must be in the energized state every day, and the energized state continues six hours or more. Therefore, when one day (i.e., 24 hours) is regarded as a basic period, the ratio of the energized period to the basic period is 0.25 (=6/24). Therefore, when the state of the controller 100 is changed from the non-energized state to the energized state, if the total of the energized period of the controller 100 since the previous execution of the non-energized period obtaining process is less than six hours, it is determined that 24 hours have not elapsed since the previous execution of the non-energized period obtaining process, and the non-energized period will not be estimated (obtained). Meanwhile, if the total of the energized period of the controller 100 since the previous execution of the non-energized period obtaining process is six hours or more, it is determined that 24 hours (i.e., basic period) have elapsed since the previous execution of the non-energized period obtaining process, and the non-energized period will be estimated. According to the above configuration, it is possible that the non-energized period can be estimated to some extent.

According to another example, the non-energized period may be estimated based on the internal information which the printer 1 can internally obtains. For example, the non-energized period can be estimated to some extent based on the temperature history information. For example, if there is correlation between the temperature data which is obtained based on the measurement result of the temperature sensor 50 and the atmosphere temperature, transition of the temperature data for one day is considered to have a regularity. Concretely, the temperature indicated by the temperature data is the lowest at around five o'clock and the highest at around fourteen o'clock. Further, the temperature keeps rising from five o'clock to fourteen o'clock, and keeps falling from fourteen o'clock to five o'clock next day. Therefore, in one day, even if four or five hours of non-energized period exists, the non-energized period can be estimated to some extent based on the transition of the temperature data stored in the temperature history information 104*b*.

It is noted that the CPU 101 compensate the elapsed time count value of the elapsed time counter 104*e* or the obtained date/time of the temperature history information 104*b* based on the non-energized period obtained by the non-energized period obtaining process.

Next, the temperature data estimating process will be described. The temperature data during the non-energized state should be estimated based on the internal information of the printer 1, differing from the above-described non-energized period. According to the embodiment, the CPU 101 estimates the temperature data during the non-energized state based on the temperature history information 104*b*.

In the temperature history information 104*b*, the obtained date/time when the temperature data is obtained is stored in association with the temperature data. Therefore, for one day, a time zone when each piece of temperature data is obtained can be known. Further, time zones when the CPU 101 is in the non-energized state can be obtained based on the obtained date/time associated with the temperature data which is obtained immediately before and immediately after the non-energized sate stored in the temperature history information 104*b*.

As mentioned above, when there is correlation between the temperature data and the atmospheric temperature, there is a regularity in the transition of temperature in one day. Therefore, it is likely that a difference between values of the actual temperature data in a certain time zone in the non-energized state, and the temperature data, among a plurality of pieces of the temperature data stored in the temperature history information 104*b*, obtained at the same time zone (i.e., the temperature data obtained in the same time zone, particularly, within a most recent particular period (e.g., within 30 days)) is small. Thus, referring to the temperature history information 104*b*, if the temperature data corresponding to all the time zones during the non-energized state is included in the temperature data obtained in the most recent 30 days, the CPU 101 estimates, referring to the temperature history information 104*b*, the temperature data during the non-energized state based on the temperature data obtained in the same time zone. For example, the CPU 101 estimates that the temperature data of the time zone between 5 a.m. to 6 a.m. when the CPU 101 is in the non-energized state is the same as the temperature data which is an average value of the temperature data obtained between 5 a.m. to 6 a.m. within most recent 30 days.

Incidentally, since the temperature data is added to the temperature history information 104*b* only when the controller 100 is only in the energized state, there is a case where the temperature data obtained in the time zone same as the time zone of the non-energized state is not included in the temperature history information 104*b*. For example, there is a case where the usage tendency of the user is configured such that, in one day, the power plug is inserted in the electrical outlet in the daytime, while the plug is removed from the electrical outlet in the night-time. In such a case, the temperature data for the night-time is not included in the temperature history information 104*b*. Even in such a case, as will be described below, the temperature data can be estimated.

When the non-energized period is relatively short (e.g., less than 12 hours), it is likely that a difference between the average of the actual temperature data during the non-energized state and the temperature data obtained immediately before the energized state is changed from the energized state to the non-energized state, or the temperature data obtained immediately after the energized state is changed from the non-energized state to the energized state is small. When the non-energized period is relatively long (e.g., 12 hours or more), there could be a case where a difference between the average of the actual temperature data during the non-energized state and the temperature data obtained immediately before the energized state is changed from the energized state to the non-energized state, or the temperature data obtained immediately after the energized state is changed from the non-energized state to the energized state is relatively large.

For example, a time zone of the temperature data which obtained immediately before or immediately after the non-energized state is a time zone at which the temperature is the highest or the lowest in a day, a difference with respect to the average of the temperature during the non-energized state becomes large. In this case, it is likely that the difference with respect to the average value of the temperature data obtained within the particular period (e.g., within 30 days) immediately before the non-energized state, or the average value of the temperature data obtained within a particular period (e.g., 24 hours) immediately after the non-energized state is smaller.

Therefore, when the non-energized period is less than 12 hours, it is estimated that the temperature data during the period of the non-energized state is the same as the temperature data obtained immediately before or after the non-energized state. According to the present embodiment, in order to more certainly suppress occurrence of the ejection failure of the ink, the temperature data during the non-energized period is estimated as a higher one of the temperature data obtained immediately before and after the non-energized state.

Incidentally, when the non-energized period is 12 hours or more, the CPU 101 estimates that the temperature data during the non-energized period is the same as the average of the temperature data obtained within 30 days immediately before the non-energized state or the average of the temperature data obtained within 24 hours or less immediately after the non-energized state. According to the present embodiment, in order to shorten the time, after transition from the energized state to the non-energized state and till the temperature data estimating process is executed, the CPU 101 estimates that, when the non-energized period is 12 hours or more, the temperature data during the non-energized period is the same as the average of the temperature data obtained within 30 days immediately before the non-energized state. It is noted that, according to the present embodiment, estimating methods are changed using 12 hours as a threshold value. However, a different value (e.g., 24 hours) may be used as the threshold value to differentiate the estimating methods.

In the table update process, the CPU 101 compensates the accumulated period table 104*e* by updating the accumulated periods based on the non-energized period obtained by the non-energized period obtaining process, and the temperature data estimated in the temperature data estimating process. For example, the obtained non-energized period is five hours, and the temperature indicated by the temperature data estimated in the temperature data estimating process is 31 degrees, the CPU 101 adds five hours to the accumulated period for the environmental temperature range of 30-35 degrees. With the above configuration, the accumulated period table 104*e* is updated to a table taking the non-energized period and the environmental temperature in the non-energized state into account.

Incidentally, as mentioned above, the non-energized period can be estimated based on the internal information of the printer 1 in the non-energized period obtaining process.

However, the accuracy of the non-energized period obtained in such a manner is lower than the non-energized period calculated based on the time information. Therefore, if the CPU 101 executes processing in accordance with the same control sequence regardless whether the non-energized period is calculated based on the time information or the internal information, there is possibility that the ink ejection characteristic is deteriorated, or the ink is uselessly consumed.

Therefore, according to the embodiment, when the non-energized period is calculated based on the time information, the CPU 101 executes processes in accordance with a first control sequence, while, when the non-energized period is calculated based on the internal information, the CPU 101 executes processes in accordance with a second control sequence which is different from the first control sequence. The second control sequence is a control sequence of which execution interval of the periodical maintenance is shorter than the first control sequence. According to the present embodiment, in the second control sequence, the estimated period estimated in the estimate period obtaining process based on the purge condition setting process is compensated by multiplying a compensation factor, which is a factor greater than one. According to the above configuration, since the estimate period is longer in the second sequence than in the first sequence, the execution interval of the periodical maintenance process can be shortened.

Next, the one example of the process of the printer 1 will be described. As shown in FIGS. 6A and 6B, the CPU 101 refers to the elapsed time counter 104*a* and the execution count information 104*c*, and determines whether or not one hour or more have elapsed since the previous execution of the history information storing process (S1). When it is determined that one hour or more have elapsed (S1: YES), the CPU 101 executes the history information storing process in which the CPU 101 obtains the temperature data based on the measurement result of the temperature sensor 50, and newly adds the obtained temperature data and current date/time obtained from the clock circuit 106 in an associated manner to the temperature history information 104*b* (S2). At this stage, the CPU 101 adds one hour to the accumulated period for the environmental temperature zone, to which the temperature indicated by the obtained temperature data belongs, in the accumulated period table 104*e* (S3). When it is determined that the non-energized state does not exist (S3: NO), the CPU 101 proceeds to S10.

When it is determined that the non-energized state exists (S3: YES), the CPU 101 determines that the non-energized period obtaining process it to be executed, and determines whether the non-energized period of the present non-energized state can be calculated (S4) based on the time information received from the external device 200. When it is determined that the non-energized period can be calculated (S4: YES), the CPU 101 calculates the non-energized period based on the time information (S5), and proceeds to S8. Incidentally, when it is determined that the non-energized period cannot be calculated (S4: NO), the CPU 101 estimates the non-energized period based on the internal information (S6), and sets the estimate flag of the flag information 104*h* stored in the memory 104 to be the on state (S7). The estimate flag is initially set to be the off state, and set to be the on state when the non-energized period is estimated based on the internal information in the non-energized period obtaining process. When the process of S7 is finished, the controller 101 proceeds to S8. It is noted that the CPU 101 also compensates the elapsed time count value of the elapsed time counter 104*a*, the obtained date/time of the temperature history information 104*b* and the like based on the obtained non-energized period in S5 and S6.

In S8, the CPU 101 executes a temperature data estimating process which will be described later with reference to FIG. 7. Then, the temperature data in the non-energized state is estimated. Next, based on the non-energized period obtained in S5 and S6, and the temperature data estimated in the temperature data estimating process (S8), the CPU 101 executes the table update process (S9) to update the accumulated period table 104*e*. Thereafter, the CPU 101 proceeds to S10.

In S10 (FIG. 6B), referring to the elapsed time counter 104*a* and the execution count information 104*c*, the CPU 101 determines whether or not 24 hours or more have elapsed since previous execution of the purge condition setting process. When it is determined that the 24 hours or more have not elapsed since the previous execution of the purge condition setting process (S10: NO), the CPU 101 returns to S1. When it is determined that 24 hours or more have elapsed since the previous execution of the purge condition setting process (S10: YES), the CPU 101 determines that the purge condition setting process should be executed. Then, the CPU 101 calculates an estimate period regarding the elapsed time (S11) since the previous execution of the periodical maintenance process (S12) based on the accumulated period table 104*e*, the growth factor table 104*f*, and the PV number calculated in the PV number calculating process. When it is determined that the estimate flag is not in the on state (S12: NO), the CPU 101 proceeds to S14. Incidentally, when it is determined that the estimate flag is in the on state (S12: YES), the CPU 101 compensates by multiplying the estimate period calculated in S11 with the compensation factor (S13), and the CPU 101 proceeds to S14.

In S14, the CPU 101 determines whether or not the estimate period is 30 days or more. When it is determined that the estimate period is not 30 days or more (S14: NO), the CPU 101 determines that it is not the execution timing of the periodical maintenance process and proceeds to S1. When the estimate period is 30 days or more (S14: YES), the CPU 101 determines that the present timing is the execution timing of the periodical maintenance process (S15). Thereafter, the CPU 101 initializes the elapsed time counter 104*a*, the accumulated period table 104*e*, and the flag information 104*h* (S16), then returns to S1.

Next, referring to FIG. 7, the temperature data estimating process will be described. The CPU 101 refers to the temperature history information 104*b* and determines whether the number of obtained pieces of the temperature data within most recent 30 days is less than a particular number (S31). When it is determined that the number of pieces of the obtained temperature data is less than the particular number (S31: YES), the CPU 101 determines that the temperature data in the non-energized state cannot be estimated based on the temperature history information 104*b*, and sets the temperature data in the non-energized state to temperature data representing a high temperature (e.g., 45 degrees or more) (S32) in order to certainly suppress occurrence of the ink ejection failure, and terminates the present process.

When it is determined that the number of pieces of obtained temperature data is not less than the particular number (S31: NO), the CPU 101 refers to the temperature history information 104*b* to determine whether there is temperature data which was obtained in the same time zone within most recent one month for each of all the time zones during the non-energized state period (S33). When there is temperature data which was obtained in the same time zone (S33: YES), the CPU 31 estimate that the temperature data in each time zone during the non-energized state period is the same as the average value of the temperature data obtained in the same time zone within the most recent one month (S34), and terminates the present process. When it is determined that there is no temperature data in the same time zone (S33: NO), the CPU 101 determines whether the non-energized period is less than 12 hours (S35). When it is determined that the non-energized period is less than 12 hours (S35: YES), the CPU 101 refers to the temperature history information 104*b* and estimates that the temperature data during the non-energized period is the same as higher one of the temperature data obtained immediately before and after the non-energized period (S36), and terminates the present process. When it is determined that the non-energized period is not less than 12 hours (S35: NO), the CPU 101 refers to the temperature history information 104*b* and estimates that the temperature data during the non-energized period is the same as the average value of the temperature data obtained within the most recent 30 days before the non-energized state (S37), and terminates the present process.

According to the above-described embodiment, when there is a non-energized period after previous execution of the periodical maintenance process, the temperature data during the non-energized state is estimated, and the execution timing of the next periodical maintenance process is set based on the estimated temperature data. With this configuration, the next periodical maintenance process can be executed at a more appropriate timing, thereby occurrence of the ejection failure being suppressed.

In the above-described embodiment, the ink passage F5 is an example of a liquid passage, and the air reservoir 75 is an example of a diverging part. Further, the CPU 101 is an example of a controller, and the non-volatile memory 104 is an example of a storage. The clock circuit 106 is an example of a time measuring part and a date/time measuring part. The power circuit 98 is an example of a power supplying device, and the communication interface 110 is an example of a receiving part.

Second Embodiment

Next, a second embodiment will be described. It is noted that, in the following description, only different parts with respect to the first embodiment will be described. According to the first embodiment, in the purge condition setting process, the execution timing of the next periodical maintenance process is set. According to the second embodiment, a purge mount in the exhaust purge in the periodical maintenance process will be set. Further, according to the second embodiment, the execution period of the periodical maintenance process is set to 30 days, and the temperature data estimating process and the purge condition setting process are executed when the periodical maintenance process is executed.

The CPU 101 is configured to causes the purge device 9 to execute a plurality of types of exhaust purges respectively corresponding to different purge amounts. According to the present embodiment, three types of purges (i.e., weak purge, medium purge, strong purge) can be executed as the exhaust purge. The medium purge satisfies at least one of conditions of (1) a rotation speed of the suction pump 11 is faster and (2) a driving period of the suction pump 11 is longer, in comparison with the weak purge. Further, the strong purge satisfies at least one of conditions of (1) the rotation speed of the suction pump 11 is faster and (2) the driving period of the suction pump 11 is longer, in comparison with the medium purge. Thus, the purge amount becomes larger in the order of the weak purge, the medium purge and the strong purge. The exhaust purge in the periodical maintenance process is basically set to the weak purge. Then, as shown in FIG. 5D, when the purge condition setting process is executed, the purge type of which the purge amount is larger is set to the exhaust purge of the periodical maintenance purge as the estimate period estimated in the estimate period obtaining process is longer.

Next, an example of the operations of the printer 1 according to the second embodiment will be described, referring to FIGS. 8A and 8B. Firstly, the CPU 101 executes a process of S51-S17 which are similar to S1-S7 described above with reference to FIG. 6A. When it is determined that the non-energized state does not exist (S53: NO), after execution of S55 or S57, the CPU 101 determines whether or not 30 days or more have elapsed since the previous execution of the periodical maintenance process, referring to elapsed time counter 104*a* (S58). When it is determined that 30 days or more have not elapsed (S58: NO), the CPU 101 returns to S51.

When it is determined that 30 days or more have elapsed (S58: YES), the CPU 101 executes the temperature data estimating process to estimate the temperature data regarding each of the non-energized periods existing after the previous execution of the periodical maintenance process based on the temperature history information 104*b* (S59). It is noted that the temperature data estimating process is omitted when there is no non-energized period after the previous execution of the periodical maintenance process.

In the temperature data estimating process, as shown in FIG. 9, the CPU 101 refers to the temperature history information 104*b* and determines whether the number of pieces of temperature data obtained within the most recent 30 days is less than the particular number (S71). When it is determined that the number of pieces of temperature data is less than the particular number (S71: YES), the CPU 101 determines that the temperature data for each non-energized state cannot be estimated accurately based on the temperature history information 104*b*, and set the strong purge flag stored in the flag information 104*g* to be an on state (S72). The strong purge flag is for causing the purge device 9 to execute the strong purge in the periodical maintenance process, regardless of the estimated period obtained based on the accumulated period table 104*e*. Therefore, if the strong purge flag is in the on state when the periodical maintenance process is executed, the strong purge is certainly executed as the exhaust purge. Accordingly, it is possible that occurrence of the ejection failure is certainly suppressed. When the process of S72 is completed, the CPU 101 terminates the temperature data estimating process. When it is determined that the number of pieces of temperature data obtained in the most recent 30 days is not less than the particular number (S71: NO), the CPU 101 executes the process of S73-S77 which is similar to the process of S33-S37 described referring to FIG. 7 to estimate the temperature data for each non-energized state, and terminates the temperature estimate process.

After execution of S59 (FIG. 8B), the CPU 101 determines whether the strong purge flag of the flag information 104*h* is in the on state (S60). When it is determined that the strong purge flag is in the on state (S60: YES), the CPU 101 sets the exhaust purge, which is executed in the periodical maintenance process, to the strong purge (S61), and proceeds to S67. When it is determined that the strong purge flag is not in the on state (S60: NO), the CPU 101 executes the table update process to update the accumulated period table 104*e* (S62) for each of the non-energized states after previous execution of the periodical maintenance process based on the non-energized periods obtained in the non-energized period obtaining process and the temperature data estimated in the temperature data estimating process in S59. It is noted that the process of S62 is omitted when the non-energized state does not exist after the previous execution of the periodical maintenance process.

Next, the CPU executes the process of S63-S65 (FIG. 8B), which is similar to the process of S11-S13 (FIG. 6B), to obtain the estimate period. Then, the CPU 101 sets one of the weak purge, the medium purge and the strong purge to the exhaust purge executed in the periodical maintenance process based on the obtained maintenance period (S66). Incidentally, as described above, in the second control sequence when the estimate flag of the flag information 104*h* is on, the value of the estimate period is relatively large in comparison with the case of the first control sequence. Therefore, in the second control sequence, the purge amount of the exhaust purge in the periodical maintenance is larger in comparison with a case of the first control sequence. When the process of S66 is completed, the CPU 101 proceeds to S67.

In the process of S67, the CPU 101 executes the periodical maintenance process. At this stage, the exhaust purge is executed in accordance with the type of the purge set in the process of S61 or S66. Thereafter, the CPU 101 initializes the elapsed time counter 104*a*, the accumulated period table 104*e*, and the flag information 104*h* (S68), and returns to SM.

According to the present embodiment, when there exists the non-energized state(s) after the previous execution of the periodical maintenance process, the temperature data in the non-energized state(s) is estimated, and the purge amount of the exhaust purge in the next periodical maintenance process is set. According to the above configuration, since the purge amount of the exhaust purge in the next periodical maintenance process can be set to the appropriate amount, it is possible to suppress occurrence of the ejection failure.

It is noted that the aspects of the present disclosures need not be limited to the configurations of the above-described embodiments, but can be modified in various ways. For example, according to the first and second embodiments, only one condition of the execution timing and the purge amount of the exhaust purge for the next periodical maintenance process is set in the purge condition setting process. However, the configurations may be modified such that both conditions may be set. Further, in the purge condition setting process, a further condition of the rotation speed of the suction pump 11 when the exhaust purge is executed may additionally be set.

The exhaust passage 74 for the exhaust purge may be omitted. However, when the exhaust passage 74 is not provided, it is necessary to remove all the air existing in the ink passage F5 from the nozzles 44 at the end of the ink passage F5 only by suction purge. In the purge condition setting process, only one of the condition of the execution timing of the periodical maintenance and the condition of the purge amount of the suction purge is set.

In the above-described embodiments, the ink ejection operation executed by the purge device 9 is the suction purge for applying a suction force to the nozzles 44. Alternatively, for example, a pressure purge for driving a pressure pump, which is provided at an intermediate portion of the supply tube 22, to supply the ink to the head unit 5, thereby the nozzles 44 are caused to discharge the ink may be employed instead of the suction purge. Further, the purge device may be configured to execute both the suction purge and the pressure purge.

It is only necessary that the temperature data estimating process is a process to estimate the temperature data in the non-energized state based on the temperature history information 104*b*, and is not necessarily be limited to the configuration of the above-described embodiments. For example, regardless of the length of the non-energized period, the temperature data during the non-energized state can be estimated as the temperature data same as one of the temperature data obtained immediately before and after the non-energized state. Similarly, regardless of the length of the non-energized period in the non-energized state, the temperature data during non-energized state may be estimated as the average of the temperature data obtained within the particular period immediately before or after the non-energized state. Further alternatively, when it is determined, based on the temperature history information 104*b*, that the temperature data obtained at the time zone same as the time zone during the non-energized state is included in the temperature data obtained within the most recent 30 days, the temperature data in the time zone which is a part of the period of the non-energized state may be estimated based on the temperature data obtained at the same time zone.

As described above, the non-energized period can be calculated based on the time information obtained from the external device 200. However, when the internal clock of the external device 200 is inaccurate, for example, because the internal clock is not compensated based on the NTP server, the time information mentioned above is also inaccurate. Therefore, when the non-energized state exists after previous execution of the periodical maintenance, there is a case where accuracy of the elapsed time count value of the elapse time counter 104*a* is relatively low in comparison with a case where the non-energized state does not exist. Therefore, when the non-energized state exists after previous execution of the periodical maintenance process, a compensation operation is applied to the obtained estimated period by multiplying the compensation factor (which is greater than one) to the obtained estimated period. In the purge condition setting process, the execution timing of the periodical maintenance process may be determined based on the above-mentioned estimated period. With this configuration, occurrence of the ejection failure of the ink can certainly be suppressed.

The power circuit 98 may be provided with a storage battery. The storage battery charges the electrical power supplied from the commercial power source. When the electrical power cannot be supplied from the commercial power source, for example, when the power plug is removed from the electrical outlet, the storage battery supplies the charged electrical power to the controller 100. With this configuration, as the diving power is supplied from the storage battery, even when the electrical power is not received from the commercial power source, the controller 100 is in the energized state for a particular period of time. It is noted, however, that if the time period during which the power plug is removed from the electrical outlet becomes relatively long, the storage battery is out of charge, and the controller 100 become in the non-energized state. Therefore, in such a case, it is necessary to estimate the temperature data during the non-energized state.

According to the aspects of the present disclosures, the above-described configuration may be applied to a so-called line-type inkjet printer which is configured such that an image is formed on a sheet conveyed by a sheet conveyor with the inkjet head being arranged at a fixed position. In the above-described embodiments, the aspects of the present disclosures are applied to the inkjet printer which is configured to form an image by ejecting ink droplets to the sheet. However, the aspects of the present disclosures may be applied to various liquid ejection devices for purposes other than the image formation.

What is claimed is:

1. A liquid ejection device, comprising:

a head formed with nozzles from which liquid is ejected;

a tank storing the liquid;

a liquid passage connecting the tank and the head;

a purge device;

a temperature sensor;

a storage;

a controller; and a power supply configured to supply an electrical power to the controller, the controller is configured to execute:

causing the purge device to perform a purge operation of forcibly discharging the liquid from the nozzles;

obtaining temperature data based on a measurement result of the temperature sensor when the controller is in an energized state in which an electrical power is supplied from the power supply and causing the storage to store temperature history information of the obtained temperature data, the temperature data being temperature or at least one of parameters having correlation with the temperature;

determining whether there occurs a non-energized state where the electrical power is not supplied from the power supply after the purge operation was previously executed;

estimating the temperature data in the non-energized state based on the temperature history information stored in the storage when the controller determines that the non-energized state exists after previous execution of the purge operation; and setting a purge condition including at least one of execution timing and a discharged amount of the liquid forcibly discharged from the nozzles by the purge device of a next purge operation to be executed next to the previously executed purge operation based on an elapsed time from previous execution of the purge operation and the temperature history information stored in the storage, the controller setting the purge condition based on the estimated temperature data in the non-energized state in addition to the elapsed time and the temperature history information when the controller determines that there exists the non-energized state after the previous execution of the purge operation.

2. The liquid ejection device according to claim 1, wherein the controller is configured to estimate that the temperature data in the non-energized state is temperature data same as one of the temperature data obtained immediately before the state of the controller is changed from the energized state to the non-energized state, and the temperature data obtained immediately after the state of the controller is changed from the non-energized state to the energized state, referring to the temperature history information stored in the storage.

3. The liquid ejection device, according to claim 1, wherein the controller is configured to estimate that the temperature data in the non-energized sate is same as one of an average of the temperature data obtained during a particular period immediately before the state of the controller is changed from the energized state to the non-energized sate, and an average of the temperature data obtained during a particular period immediately after the state of the controller has been changed from the energized sate to the non-energized state with referring to the temperature history information of the temperature data stored in the storage.

4. The liquid ejection device according to claim 1, wherein the controller is configured to determine whether or not a period of the non-energized state is equal to or greater than a particular threshold value when the controller determines that the non-energized state exists after the previous execution of the purge operation, wherein the controller is configured to:

when it is determined that the period of the non-energized period is less than the particular threshold value, estimate that the temperature data in the non-energized sate is same as one of an average of the temperature data obtained immediately before the state of the controller is changed from the energized state to the non-energized sate, and an average of the temperature data obtained immediately after the state of the controller has been changed from the energized sate to the non-energized state with referring to the temperature history information of the temperature data stored in the storage; and when it is determined that the period of the non-energized period is equal to or greater than the particular threshold value, estimate that the temperature data in the non-energized sate is same as one of an average of the temperature data obtained during a particular period immediately before the state of the controller is changed from the energized state to the non-energized sate, and an average of the temperature data obtained during a particular period immediately after the state of the controller has been changed from the energized sate to the non-energized state with referring to the temperature history information of the temperature data stored in the storage.

5. The liquid ejection device according to claim 1, wherein the controller is configured to:

when it is determined that the non-energized state exists after the previous execution of the purge operation, obtain information regarding a time zone when the controller was in the non-energized state;

when there is the temperature data obtained in a same time zone as the time zone of the non-energized state in the temperature history information, estimate the temperature data in the non-energized state based on the temperature data obtained in the same time zone.

6. The liquid ejection device according to claim 1, wherein the purge condition includes a condition regarding the discharge amount discharged by the purge device in the next purge operation, wherein, when it is determined that the number of pieces of obtained temperature data obtained after execution of the previous purge operation is less than a particular number in the temperature history information, the controller sets the discharge amount discharged by the purge device in the next purge operation as the largest settable amount.

7. The liquid ejection device according to claim 1, wherein the power supply is configured to supply the electrical power from the commercial power source to the controller, when the power supply receives the electrical power from the commercial power source, the controller is in the energized state and is capable of obtaining the temperature data based on the measurement result of the temperature sensor and causing the storage to store the temperature history information of the obtained temperature data in the storage; and when the power supply does not receive the electrical power from the commercial power source, the controller is in the non-energized state and is unable to obtain the temperature data based on the measurement result of the temperature sensor or store the temperature history information in the storage.

8. The liquid ejection device according to claim 1, further comprising:

a timer; and a receiver configured to externally receive time information, wherein the controller is configured to execute:

causing the storage to store a measured period measured by the timer after previous execution of a purge operation in the energized state;

when it is determined that there exists the non-energized state after the previous execution of the purge operation, determining whether the controller calculates a period of the non-energized state based on the time information externally received; and when it is determined that the controller does not calculate the period of the non-energized state, estimating the period of the non-energized state referring to internal information, which is obtained internally, for estimating the non-energized sate, wherein, the controller is configured to:

when it is determined that the non-energized period does not exist after the previous execution of the purge operation, set the measured period stored in the storage as the elapsed time;

wherein it is determined that there exists the non-energized period after the previous execution of the purge operation, and it is determined that the controller calculates the period of the non-energized state, set a sum of the measured period stored in the storage and the period of the non-energized state calculated based on the time information as the elapsed time; and when it is determined that the non-energized state exists after the previous execution of the purge operation and it is determined that the controller does not calculate the period of the non-energized state, set a sum of the measured period stored in the storage and the estimated non-energized period as the elapsed time.

9. The liquid ejection device according to claim 8, wherein, when it is determined that the non-energized state exists after the previous execution of the purge operation, the controller is configured to:

when it is determined that the controller calculates the period of the non-energized state, execute the purge operation in accordance with a first control sequence; and when it is determined that the controller does not calculate the period of the non-energized state, execute the purge operation in accordance with a second control sequence, the second control sequence satisfying at least one of a condition in which an execution interval of a purge operation to be executed in accordance with the second control sequence is shorter and a condition in which an discharge amount discharged by the purge device in the purge operation to be executed in accordance with the second control sequence is greater, in comparison with the first control sequence.

10. The liquid ejection device according to claim 1, further comprising a timer configured to measure a date and time, wherein the controller is configured to obtain the temperature data based on the measurement result of the temperature sensor and cause the storage to store the temperature history information at every particular period in the energized state, and wherein, in each execution of obtaining the temperature data based on the measurement result of the temperature sensor and causing the storage to store the temperature history information, the controller adds the temperature data obtained based on the measured result of the temperature sensor and date and time measured by the timer when the temperature data was obtained to the temperature history information stored in the storage in an associated manner.

11. A liquid ejection device, comprising:

a head formed with nozzles from which liquid is ejected;

a tank storing the liquid;

a liquid passage connecting the tank and the head;

an exhaust passage diverged from a diverging part at an intermediate part of the liquid passage toward outside;

a purge device;

a temperature sensor;

a storage;

a controller; and a power supply configured to supply an electrical power to the controller, the controller is configured to execute:

causing the purge device to perform a purge operation of forcibly discharging air inside the liquid passage together with the liquid through the exhaust passage;

obtaining temperature data based on a measurement result of the temperature sensor when the controller is in an energized state in which an electrical power is supplied from the power supply and causing the storage to store temperature history information of the obtained temperature data, the temperature data being temperature or at least one of parameters having correlation with the temperature;

determining whether there occurs a non-energized state where the electrical power is not supplied from the power supply after the purge operation was previously executed;

estimating the temperature data in the non-energized state based on the temperature history information stored in the storage when the controller determines that the non-energized state exists after previous execution of the purge operation; and setting a purge condition including at least one of execution timing and a total discharge amount of the liquid and the air forcibly discharging from liquid passage toward outside via the exhaust passage in a next purge operation to be executed next to the previously executed purge operation based on an elapsed time from previous execution of the purge operation and the temperature history information stored in the storage, the controller setting the purge condition based on the estimated temperature data in the non-energized state in addition to the elapsed time and the temperature history information when the controller determines that there exists the non-energized state after the previous execution of the purge operation.

12. The liquid ejection device according to claim 11, wherein the controller is configured to estimate that the temperature data in the non-energized state is temperature data same as one of the temperature data obtained immediately before the state of the controller is changed from the energized state to the non-energized state, and the temperature data obtained immediately after the state of the controller is changed from the non-energized state to the energized state, referring to the temperature history information stored in the storage.

13. The liquid ejection device, according to claim 11, wherein the controller is configured to estimate that the temperature data in the non-energized sate is same as one of an average of the temperature data obtained during a particular period immediately before the state of the controller is changed from the energized state to the non-energized sate, and an average of the temperature data obtained during a particular period immediately after the state of the controller has been changed from the energized sate to the non-energized state with referring to the temperature history information of the temperature data stored in the storage.

14. The liquid ejection device according to claim 11, wherein the controller is configured to determine whether or not a period of the non-energized state is equal to or greater than a particular threshold value when the controller determines that the non-energized state exists after the previous execution of the purge operation, wherein the controller is configured to:

when it is determined that the period of the non-energized period is less than the threshold value, estimate that the temperature data in the non-energized sate is same as one of an average of the temperature data obtained immediately before the state of the controller is changed from the energized state to the non-energized sate, and an average of the temperature data obtained immediately after the state of the controller has been changed from the energized sate to the non-energized state with referring to the temperature history information of the temperature data stored in the storage; and when it is determined that the period of the non-energized period is equal to or larger than the threshold value, estimate that the temperature data in the non-energized sate is same as one of an average of the temperature data obtained during a particular period immediately before the state of the controller is changed from the energized state to the non-energized sate, and an average of the temperature data obtained during a particular period immediately after the state of the controller has been changed from the energized sate to the non-energized state with referring to the temperature history information of the temperature data stored in the storage.

15. The liquid ejection device according to claim 11, wherein the controller is configured to:

when it is determined that the non-energized state exists after the previous execution of the purge operation, obtain information regarding a time zone when the controller was in the non-energized state;

when there is the temperature data obtained in a same time zone as the time zone of the non-energized state in the temperature history information, estimate the temperature data in the non-energized state based on the temperature data obtained in the same time zone.

16. The liquid ejection device according to claim 11, wherein the purge condition includes a condition regarding discharge amount discharged by the purge device in the next purge operation, wherein, when it is determined that the number of pieces of obtained temperature data obtained after execution of the previous purge operation is less than a particular number in the temperature history information, the controller sets the discharge amount discharged by the purge device in the next purge operation as the largest settable amount.

17. The liquid ejection device according to claim 11, wherein the power supply is configured to supply the electrical power from the commercial power source to the controller, when the power supply receives the electrical power from the commercial power source, the controller is in the energized state and is capable of obtaining the temperature data based on the measurement result of the temperature sensor and causing the storage to store the temperature history information of the obtained temperature data; and when the power supply does not receive the electrical power from the commercial power source, the controller is in the non-energized state and is unable to obtain the temperature data based on the measurement result of the temperature sensor or store the temperature history information in the storage.

18. The liquid ejection device according to claim 11, further comprising:

a timer; and a receiver configured to externally receive time information, wherein the controller is configured to execute:

causing the storage to store a measured period measured by the timer after previous execution of a purge operation in the energized state;

when it is determined that there exists the non-energized state after the previous execution of the purge operation, determining whether the controller calculates a period of the non-energized state based on the time information externally received; and when it is determined that the controller does not calculate the period of the non-energized state, estimating the period of the non-energized state referring to internal information, which is obtained internally, for estimating the non-energized sate, wherein, the controller is configured to:

when it is determined that the non-energized period does not exist after the previous execution of the purge operation, set the measured period stored in the storage as the elapsed time;

wherein it is determined that there exists the non-energized period after the previous execution of the purge operation, and it is determined that the controller calculates the period of the non-energized state, set a sum of the measured period stored in the storage and the period of the non-energized state calculated based on the time information as the elapsed time; and when it is determined that the non-energized state exists after the previous execution of the purge operation and it is determined that the controller does not calculate the period of the non-energized state, set a sum of the measured period stored in the storage and the estimated non-energized period as the elapsed time.

19. The liquid ejection device according to claim 18, wherein, when it is determined that the non-energized state exists after the previous execution of the purge operation, the controller is configured to:

when it is determined that the controller calculates the period of the non-energized state, execute the purge operation in accordance with a first control sequence; and when it is determined that the controller does not calculate the period of the non-energized state, execute the purge operation in accordance with a second control sequence, the second control sequence satisfying at least one of a condition in which an execution interval of a purge operation to be executed in accordance with the second control sequence is shorter and a condition in which an discharge amount discharged by the purge device in the purge operation to be executed in accordance with the second control sequence is greater, in comparison with the first control sequence.

20. The liquid ejection device according to claim 11, further comprising a date and time measuring circuit, wherein the controller is configured to obtain the temperature data based on the measurement result of the temperature sensor and store the temperature history information in the storage at every particular period in the energized state, and wherein, in each execution of obtaining the temperature data based on the measurement result of the temperature sensor and causing the storage to store the temperature history information, the controller adds the temperature data obtained based on the measured result of the temperature sensor and date and time measured by the date and time measuring circuit when the temperature data was obtained to the temperature history information stored in the storage in an associated manner.

* * * * *